US009765284B2

(12) United States Patent
Man et al.

(10) Patent No.: US 9,765,284 B2
(45) Date of Patent: Sep. 19, 2017

(54) VISCOELASTIC AMPHOTERIC SURFACTANT BASED CLEANING COMPOSITIONS

(71) Applicant: Ecolab USA Inc., St. Paul, MN (US)

(72) Inventors: Victor Fuk-Pong Man, St. Paul, MN (US); Michael Charles Denoma, Vadnais Heights, MN (US); Yvonne Marie Killeen, South St. Paul, MN (US); Susan Maloney Viall, Rosemount, MN (US)

(73) Assignee: Ecolab USA Inc., Saint Paul, MN (US)

( * ) Notice: Subject to any disclaimer, the term of this patent is extended or adjusted under 35 U.S.C. 154(b) by 42 days.

(21) Appl. No.: 14/688,005

(22) Filed: Apr. 16, 2015

(65) Prior Publication Data

US 2015/0218488 A1 Aug. 6, 2015

Related U.S. Application Data

(63) Continuation of application No. 13/687,168, filed on Nov. 28, 2012, now Pat. No. 9,157,049.

(51) Int. Cl.

| | |
|---|---|
| ***C11D 1/75*** | (2006.01) |
| ***C11D 1/90*** | (2006.01) |
| ***C11D 1/92*** | (2006.01) |
| ***C11D 1/94*** | (2006.01) |
| ***C11D 3/10*** | (2006.01) |
| ***C11D 1/88*** | (2006.01) |
| ***C11D 3/04*** | (2006.01) |
| ***C11D 3/06*** | (2006.01) |
| ***C11D 3/08*** | (2006.01) |
| ***C11D 3/20*** | (2006.01) |
| ***C11D 3/33*** | (2006.01) |
| ***C11D 3/36*** | (2006.01) |
| ***C11D 17/00*** | (2006.01) |

(52) U.S. Cl.

CPC ..... *C11D 1/90* (2013.01); *C11D 1/75* (2013.01); *C11D 1/88* (2013.01); *C11D 1/92* (2013.01); *C11D 1/94* (2013.01); *C11D 3/044* (2013.01); *C11D 3/046* (2013.01); *C11D 3/06* (2013.01); *C11D 3/08* (2013.01); *C11D 3/10* (2013.01); *C11D 3/2075* (2013.01); *C11D 3/2079* (2013.01); *C11D 3/33* (2013.01); *C11D 3/361* (2013.01); *C11D 3/364* (2013.01); *C11D 3/365* (2013.01); *C11D 17/003* (2013.01)

(58) Field of Classification Search

CPC ..... C11D 11/0023; C11D 1/75; C11D 1/90; C11D 1/92; C11D 1/94; C11D 3/044; C11D 3/10

See application file for complete search history.

(56) References Cited

U.S. PATENT DOCUMENTS

| | | | | |
|---|---|---|---|---|
| 3,489,686 | A | 1/1970 | Parran, Jr. | |
| 5,389,157 | A * | 2/1995 | Smith | C11D 1/90 134/22.13 |
| 5,576,279 | A | 11/1996 | Pyles | |
| 5,700,771 | A | 12/1997 | Hardy et al. | |
| 5,833,764 | A * | 11/1998 | Rader | C11D 17/003 134/22.11 |
| 6,221,827 | B1 | 4/2001 | Mendoza Cruz et al. | |
| 6,258,859 | B1 | 7/2001 | Dahayanake et al. | |
| 6,482,866 | B1 | 11/2002 | Dahayanake et al. | |
| 6,608,020 | B1 | 8/2003 | Durbut et al. | |
| 6,703,352 | B2 | 3/2004 | Dahayanake et al. | |
| 6,831,108 | B2 | 12/2004 | Dahanayake et al. | |
| 7,025,883 | B1 | 4/2006 | Olivier | |
| 7,238,648 | B2 | 7/2007 | Dahayanake et al. | |
| 7,279,446 | B2 | 10/2007 | Colaco et al. | |
| 7,481,935 | B2 | 1/2009 | Olivier | |
| 7,999,035 | B2 | 8/2011 | Boeckh et al. | |
| 2002/0069901 | A1 | 6/2002 | Evers | |
| 2003/0119706 | A1 | 6/2003 | Pfeiffer et al. | |
| 2004/0097385 | A1* | 5/2004 | Chen | A61K 8/042 510/130 |
| 2007/0004609 | A1 | 1/2007 | Hloucha et al. | |
| 2009/0111716 | A1 | 4/2009 | Hough et al. | |
| 2009/0215662 | A1 | 8/2009 | Boeckh et al. | |

(Continued)

FOREIGN PATENT DOCUMENTS

| | | |
|---|---|---|
| EP | 0911022 | 4/1999 |
| EP | 0916720 | 5/1999 |
| WO | 9723546 | 7/1997 |
| WO | 9728207 | 8/1997 |
| WO | 9728208 | 8/1997 |
| WO | 9907815 | 2/1999 |
| WO | 2010025116 | 3/2010 |
| WO | 2011143602 | 11/2011 |

OTHER PUBLICATIONS

Angelescu, Daniel George, et al., "Adsorption of Branched-Linear Polyethyleneimine—Ethylene Oxide Conjugate on Hydrophilic Silica Investigated by Ellipsometry and Monte Carlo Simulations", Langmuir, ACS Publications 2011, pp. 9961-9971.

(Continued)

*Primary Examiner* — Charles Boyer

(74) *Attorney, Agent, or Firm* — McKee, Voorhees & Sease, PLC

(57) ABSTRACT

Alkaline or neutral viscoelastic cleaning compositions are disclosed which use non polymer thickening agents. According to the invention, cleaning compositions have been developed using viscoelastic surfactants in a neutral, acidic or alkaline cleaning formulations. These provide the dual benefit of thickening as well as an additional cleaning, thereby improving performance. Applicants have also identified several pseudo linking agents which when, used with viscoelastic surfactants provide viscoelasticity in alkaline cleaning compositions.

16 Claims, 18 Drawing Sheets

(56) References Cited

U.S. PATENT DOCUMENTS

| | | | | |
|---|---|---|---|---|
| 2010/0294498 | A1 | 11/2010 | Svoboda et al. | |
| 2011/0092398 | A1* | 4/2011 | Dahanayake | A61K 8/02 507/240 |
| 2012/0122747 | A1 | 5/2012 | Nekmard et al. | |
| 2012/0252715 | A1* | 10/2012 | McConaughy | A61Q 5/02 510/438 |
| 2012/0276210 | A1* | 11/2012 | Dihora | A61K 8/11 424/497 |
| 2013/0231269 | A1* | 9/2013 | Li | C09K 8/68 507/240 |

OTHER PUBLICATIONS

BASF The Chemical Company, "Care Chemicals & Formulators, Lupasol types", issued Apr. 2010, pp. 1-10.
Procter & Gamble Professional, "Material Safety Data Sheet—Dawn Heavy Duty Floor Cleaner", Version 5, pp. 1-4 Oct. 28, 2010.
Procter & Gamble Professional, "Material Safety Data Sheet—Dawn Heavy Duty Floor Cleaner—concentrate", Version 3, pp. 1-5, Nov. 1, 2010.
Procter & Gamble Professional, "Material Safety Data Sheet—Dawn Liquid Detergent for Power Wash Sinks—concentrate", Version 5, pp. 1-5, Apr. 5, 2011.
Procter & Gamble Professional, "Material Safety Data Sheet—Dawn Liquid Detergent for Power Wash Sinks", Version 3, pp. 1-4, Nov. 1, 2010.
Procter & Gamble Professional, "Material Safety Data Sheet—Dawn Manual Pot and Pan Detergent—Concentrate", Version 8, pp. 1-5,Nov. 3, 2010.
Procter & Gamble Professional, "Material Safety Data Sheet—Dawn Manual Pot and Pan Detergent", Version 6, pp. 1-4 Nov. 1, 2010.
Procter & Gamble Professional, "Material Safety Data Sheet—Dawn Professional Dish Detergent", Version 1, pp. 1-5, May 2, 2012.
Procter & Gamble Professional, "Material Safety Data Sheet—Dawn Ultra Heavy Duty Degreaser concentrate", Version 3, pp. 1-5, May 4, 2011.
Procter & Gamble Professional, "Material Safety Data Sheet—Mr. Clean Magic Eraser with the Grease Fighting Power of Dawn", pp. 1-5, Jun. 30, 2010.
International Searching Authority, "The International Search Report and the Written Opinion of the International Searching Authority" issued in connection to International Application No. PCT/US2013/029963, 13 pages, mailed Jul. 25, 2013.
International Searching Authority, "The International Search Report and the Written Opinion of the International Searching Authority" issued in connection to International Application No. PCT/US2013/071550, 15 pages, mailed Feb. 24, 2014.
International Searching Authority, "The International Search Report and the Written Opinion of the International Searching Authority" issued in connection to International Application No. PCT/US2013/071549, 15 pages, mailed Feb. 24, 2014.

* cited by examiner

VISCOELASTIC AMPHOTERIC SURFACTANT BASED CLEANING COMPOSITIONS

CROSS REFERENCE TO RELATED APPLICATIONS

This is a Continuation Application of U.S. Ser. No. 13/687,168 filed Nov. 28, 2012, herein incorporated by reference in its entirety.

FIELD OF THE INVENTION

The present invention relates to cleaning compositions employing viscoelastic surfactants, and optionally pseudo-crosslinking agents as thickeners. The invention further also relates to methods of making these compositions, and to methods employing these compositions in acidic, caustic, or neutral cleaning environments.

BACKGROUND OF THE INVENTION

Many cleaning compositions include a thickening agent to impart a level of viscosity to the composition, and to provide increased contact time on surfaces to be cleaned. Such compositions are presently used in many applications, such as retail, industrial and institutional including grease cutters, clinging lime scale removers, shower wall cleaners, bathtub cleaners, hand sanitizing gels, disinfectant gels, hand-soaps, teat dips, coatings, stabilized enzymes, structured liquids, and the like. Traditionally, these compositions use a polymer thickening agent to impart the desired viscosity. Polymeric thickeners, e.g. starches, thicken by entanglement of the polymeric chains.

Examples of commonly used polymeric thickening agents include guar gums and derivatives thereof, cellulose derivatives, biopolymers, and the like. Water soluble polymers, particularly polysaccharide polymers, such as, for example, guar, guar derivatives, starches, and cellulosic polymers, are commercially available materials used in a variety of applications, including as ingredients in food products, personal care compositions, agricultural pesticide compositions, and compositions, such as fracturing fluids, for use in oilfield applications.

The use of polymeric thickening agents has certain drawbacks. Such thickeners can degrade under the influence of mechanical shear or chemical scission (e.g. by oxidation or hydrolysis) of the polymeric chains which results in a loss of viscosity and, thus, suspension stability. The polymeric thickening agent may leave an undesirable gel residue on a surface to be cleaned. It is also believed that the cleaning action of at least some of the active cleaning components within the composition is reduced with a consequent and marked reduction in the cleaning action required for effective cleaning and oily soil removal. While not wishing to be bound by any theory, it is believed that the polymer thickener may act as a barrier, and slows down the diffusion of at least some of the active cleaning ingredients, thereby reducing contact with the soil. Additionally, it is believed that the polymer thickener may act to dilute the active cleaning agents within the cleaning composition, thereby reducing the cleaning effectiveness.

The term "viscoelastic" refers to viscous fluids having elastic properties, i.e., the liquid at least partially returns to its original form when an applied stress is released. Thickened aqueous viscoelastic fluids have been used in hydraulic fluids in lubricant and hydraulic fracturing fluids to increase permeability in oil production.

The property of viscoelasticity in general is well known and reference is made to S. Graysholt, Journal of Coll. And Interface Sci., 57(3), 575 (1976); Hoffmann et al., "Influence of Ionic Surfactants on the Viscoelastic Properties of Zwitterionic Surfactant Solutions", Langmuir, 8, 2140-2146 (1992); and Hoffmann et al., The Rheological Behaviour of Different Viscoelastic Surfactant Solutions, Tenside Surf. Det., 31, 389-400, 1994. Viscoelasticity is caused by a different type of micelle formation than the usual spherical micelles formed by most surfactants. Viscoelastic surfactant fluids form worm-like, rod-like or cylindrical micelles in solution. The formation of long, cylindrical micelles creates useful rheological properties. The viscoelastic surfactant solution exhibits shear thinning behavior, and remains stable despite repeated high shear applications. By comparison, the typical polymeric thickener will irreversibly degrade when subjected to high shear.

One can see that is would be highly desirable to have viscoelastic cleaning composition. Thus there is a need in the art for cleaning compositions with cleaning capabilities where the composition has the desired viscosity for sufficient contact time, but without the other deficiencies of presently available polymer based thickeners.

Accordingly it is an object herein to provide a cleaning composition that includes a viscoelastic surfactant.

It is yet another object of the invention to provide a cleaning composition with a thickening agent that can also impart a cleaning function to the composition.

It is yet another object of the invention to provide a cleaning composition using a viscoelastic surfactant that can be formulated as either an acidic, neutral or caustic cleaner.

It is yet another object of the invention to provide a cleaning composition using a viscoelastic surfactant that has better cling and reduced misting than typical cleaners which employ polymer based thickeners.

It is yet another object of the invention to provide a cleaning composition that is safe, environmentally friendly and economically feasible.

Other objects, aspects and advantages of this invention will be apparent to one skilled in the art in view of the following disclosure, the drawings, and the appended claims.

SUMMARY OF THE INVENTION

According to the invention, viscoelastic cleaning compositions are disclosed which do not rely upon polymer thickening agents for their viscoelasticity. The invention employs the use of viscoelastic surfactants in several cleaning composition formulations. These provide the dual benefit of thickening as well as an additional cleaning component, improving performance.

In one embodiment cleaning compositions are disclosed at neutral or alkaline pH with the use of non polymer thickening agents. Applicants have surprisingly found that viscoelastic surfactants, which do not impart viscoelasticity at alkaline or neutral conditions, do so when combined with an appropriate pseudo linking agent. Thus the invention includes a neutral or alkaline cleaning composition comprising a source of alkalinity, a viscoelastic surfactant and a pseudo linker. Applicants have also surprisingly found that addition of more caustic to traditional viscoelastic cleaning formulations has a deleterious effect on viscoelasticity.

Applicants have further found that, in addition to erucicdimethylamidopropylbetaine $C_{29}H_{57}N_2O_3$, other viscoelastic surfactants such as amphoteric surfactants, zwitterionic surfactants, such as dicarboxylic coconut derived sodium salt (Miranol C2M-SF), cocamidopropyl dimethylamine (Mackine GO-163), cocoamidopropyl betaine, and alkylether hydroxypropyl sultaine (Mirataine ASC), and amine oxide and mixtures thereof can be used in neutral or preferably alkaline conditions with the use of an effective pseudo linking agent. Additional viscoelastic surfactants are also contemplated as these viscoelastic surfactants all have a charge separation on the surfactant molecule, thus it is believed that other viscoelastic surfactants by be used according to the invention, including for example sultaine-type surfactants According to the invention, a pseudo linker agent may be used with the viscoelastic surfactant under alkaline or neutral conditions to impart viscoelasticity to the solution. Examples of suitable pseudo linkers include multiply charged cations, such as $Mg^{2+}$, anionic surfactants such as sodium lauryl ether sulfate (SLES), Linear Alkyl Sodium Sulfonates (LAS) neutralized Etidronic acid (dequest 2010) Diethylene triamine pentaacetic acid (DTPA) and ethoxylated PEI.

According to the invention, the ratio of active surfactant to active pseudo linker is in a ratio of linker to active viscoelastic surfactant of greater than 1:1 by percent weight of active components. Thus the invention comprises, an alkaline or neutral cleaning composition comprising from about 3% by weight to about 15% by weight of a viscoelastic surfactant; from about 0.1 to about 20% by weight of a pseudo linker, and from about 0.5 to 15% of a source of alkalinity.

In another aspect, the presently described technology provides a process to prepare a viscoelastic cleaning composition. The process can include the steps of adding to an aqueous medium 3% by weight to about 15% by weight of viscoelastic and 0.1 to about 20% by weight of a source of alkalinity, and forming a viscoelastic mixture under alkaline conditions. In certain formulations, the method will also include the step of adding an effective amount of a pseudo linker.

A novel cleaning method is also within the invention and involves applying the cleaning mixture to a surface to be cleaned, and thereafter rinsing said surface to that said cleaning composition is removed along with soil and debris.

DETAILED DESCRIPTION OF PREFERRED EMBODIMENTS

Figure 1A:
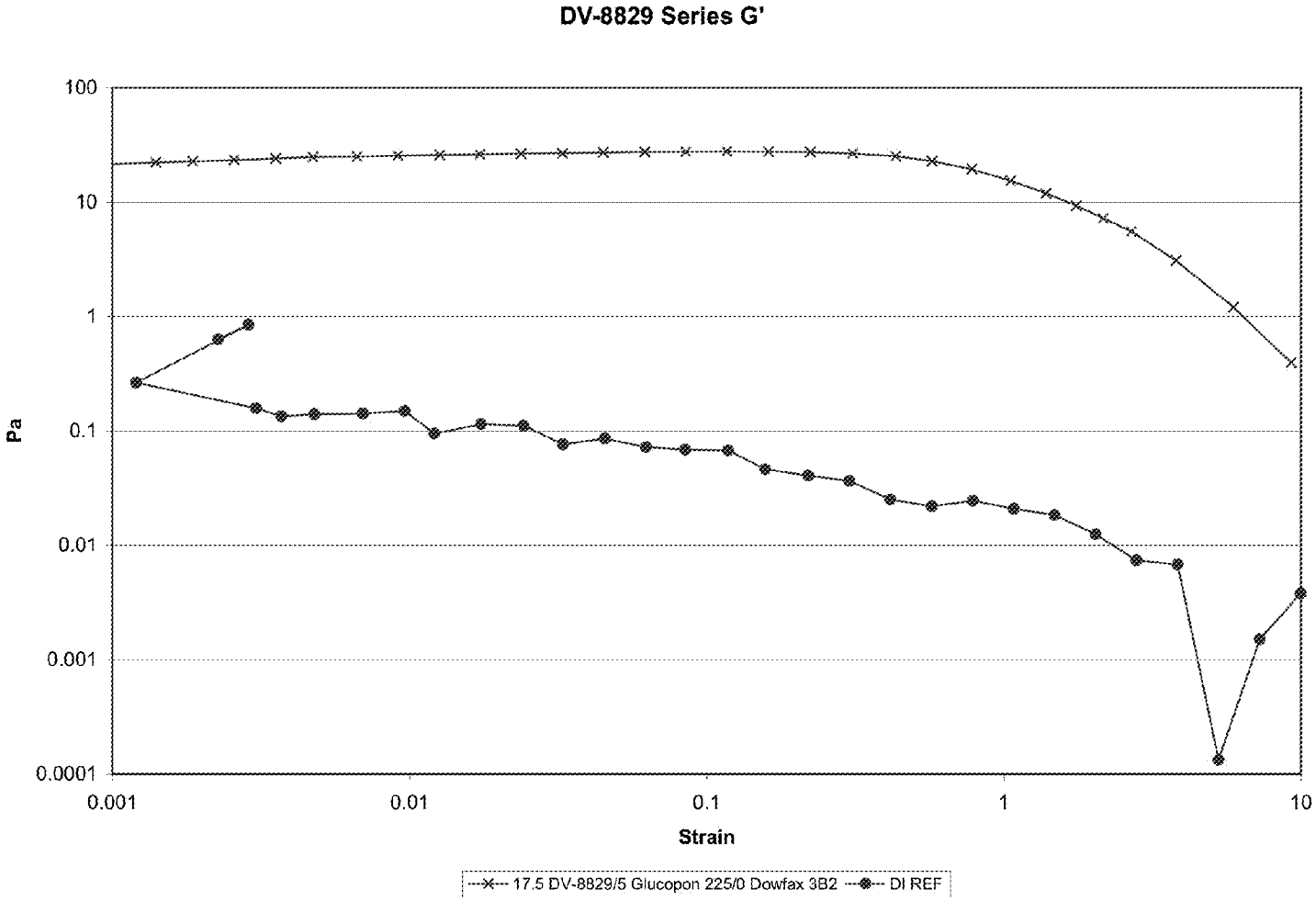
FIGS. 1A and B are graphs depicting G' (elasticity) and G" (viscosity) at Neutral conditions in a hand soap formulation utilizing the viscoelastic surfactant DV-8829. As can be seen it is possible to get viscoelasticity in different types of neutral formulas, however it can be difficult to obtain high levels of viscoelasticity in complex formulations.

While the presently described technology will be described in connection with one or more preferred embodiments, it will be understood by those skilled in the art that the technology is not limited to only those particular embodiments. To the contrary, the presently described technology includes all alternatives, modifications, and equivalents as may be included within the spirit and scope of the appended claims.

"Cleaning" means to perform or aid in soil removal, bleaching, microbial population reduction, rinsing, or combination thereof.

It should be noted that, as used in this specification and the appended claims, the singular forms "a," "an," and "the" include plural referents unless the content clearly dictates otherwise. Thus, for example, reference to a composition containing "a compound" includes a mixture of two or more compounds. It should also be noted that the term "or" is generally employed in its sense including "and/or" unless the content clearly dictates otherwise.

The term "actives" or "percent actives" or "percent by weight actives" or "actives concentration" are used interchangeably herein and refers to the concentration of those ingredients involved in cleaning expressed as a percentage minus inert ingredients such as water or salts.

As used herein, "weight percent," "wt. %," "percent by weight," "% by weight," and variations thereof refer to the concentration of a substance as the weight of that substance divided by the total weight of the composition and multiplied by 100. It is understood that, as used here, "percent," "%," and the like are intended to be synonymous with "weight percent," "wt. %," etc.

The term "about," as used herein, modifying the quantity of an ingredient in the compositions of the invention or employed in the methods of the invention refers to variation in the numerical quantity that can occur, for example, through typical measuring and liquid handling procedures used for making concentrates or use solutions; through inadvertent error in these procedures; through differences in the manufacture, source, or purity of the ingredients employed to make the compositions or carry out the methods; and the like. The term about also encompasses amounts that differ due to different equilibrium conditions for a composition resulting from a particular initial mixture. Whether or not modified by the term "about," the claims include equivalents to the quantities. All numeric values are herein assumed to be modified by the term "about," whether or not explicitly indicated. The term "about" generally refers to a range of numbers that one of skill in the art would consider equivalent to the recited value (i.e., having the same function or result). In many instances, the terms "about" may include numbers that are rounded to the nearest significant figure.

The recitation of numerical ranges by endpoints includes all numbers subsumed within that range (e.g., 1 to 5 includes 1, 1.5, 2, 2.75, 3, 3.80, 4, and 5).

Compositions of the Invention

To combat the problems associated with polymeric thickening agents, some surfactants have been used as thickening agents. When mixed with an aqueous fluid in a concentration above the critical micelle concentration, the molecules (or ions) of these viscoelastic surfactants associate to form micelles, a structure that minimizes the contact between the lyophobic portion of a surfactant molecule and the surface, for example, by aggregating the surfactant molecules into structures such as spheres, cylinders, or sheets, wherein the lyophobic portions are on the interior of the aggregate structure and the lyophilic portions are on the exterior of the structure.

These micelles function, among other purposes, to stabilize emulsions, break emulsions, stabilize a foam, change the wettability of a surface, solubilize certain materials, and/or reduce surface tension. When used as a thickening/gelling agent, the molecules (or ions) of the surfactants associate to form micelles of a certain micellar structure (e.g., rodlike, wormlike, vesicles, etc., which are referred to herein as "viscosifying micelles") and, under certain conditions (e.g., concentration, ionic strength of the fluid, etc.) are capable of, inter alia, imparting increased viscosity to a particular fluid and/or forming a gel.

However, the use of surfactants as gelling agents has proven problematic in several respects. In certain applications, large quantities of viscoelastic surfactants are required to impart the desired rheological properties to a fluid. Certain viscoelastic surfactants are less soluble in certain fluids, which may impair the ability of those surfactants to form viscosifying micelles. Viscoelastic surfactant fluids also can be unstable at high temperatures and/or in high salt concentrations due to the tendency of high salt concentrations to "screen out" electrostatic interactions between viscosifying micelles. These surfactants to date have generally been unsuccessful in imparting desired viscosity in caustic type cleaning compositions. Applicants have successfully created several cleaning viscoelastic cleaning compositions with the use of these surfactants. The viscoelastic surfactants used in the present invention may comprise any viscoelastic surfactant known in the art, any derivative thereof, or any combination thereof. These viscoelastic surfactants may be cationic, anionic, nonionic or amphoteric in nature. The viscoelastic surfactants may comprise any number of different compounds, including methyl ester sulfonates (e.g., as described in U.S. patent application Ser. Nos. 11/058,660, 11/058,475, 11/058,612, and 11/058,611, filed Feb. 15, 2005, the relevant disclosures of which are incorporated herein by reference), hydrolyzed keratin (e.g., as described in U.S. Pat. No. 6,547,871, the relevant disclosure of which is incorporated herein by reference), sulfosuccinates, taurates, amine oxides, ethoxylated amides, alkoxylated fatty acids, alkoxylated alcohols (e.g., lauryl alcohol ethoxylate, ethoxylated nonyl phenol), ethoxylated fatty amines, ethoxylated alkyl amines (e.g., cocoalkylamine ethoxylate), betaines, modified betaines, alkylamidobetaines (e.g., cocoamidopropyl betaine), quaternary ammonium compounds (e.g., trimethyltallowammonium chloride, trimethylcocoammonium chloride), derivatives thereof, and combinations thereof. The term "derivative" is defined herein to include any compound that is made from one of the listed compounds, for example, by replacing one atom in the listed compound with another atom or group of atoms, rearranging two or more atoms in the listed compound, ionizing the listed compounds, or creating a salt of the listed compound.

The present invention preferably comprises an aqueous viscoelastic surfactant based on amphoteric or zwitterionic surfactants. The amphoteric surfactant is a class of surfactant that has both a positively charged moiety and a negatively charged moiety over a certain pH range (e.g. typically slightly acidic), only a negatively charged moiety over a certain pH range (e.g. typically slightly alkaline) and only a positively charged moiety at a different pH range (e.g. typically moderately acidic), while a zwitterionic surfactant has a permanently positively charged moiety in the molecule regardless of pH and a negatively charged moiety at alkaline pH.

The cleaning compositions of the invention include water, surfactant, and a water-soluble pound selected from the group consisting of either acidic constituents and/or a source of alkalinity, depending on the ultimate desired pH of the cleaning solution. Applicants further have identified critical components which are necessary for the cleaning compositions to achieve viscoelasticity in alkaline environments.

The component of the fluid which will be present in the greatest concentration is water, i.e. typically water will be a major amount by weight of the viscoelastic fluid. Water is typically present in an amount by weight greater than or equal to about 50% by weight of the fluid. The water can be from any source so long as the source contains no contaminants which are incompatible with the other components of cleaning composition (e.g., by causing undesirable precipitation).

Viscoelastic Surfactant Based on Amphoteric or Zwitterionic Surfactants

Examples of zwitterionic surfactants useful in the present invention are represented by the formula:

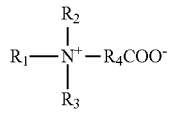

wherein $R_1$ represents a hydrophobic moiety of alkyl, alkylarylalkyl, alkoxyalkyl, alkylaminoalkyl and alkylamidoalkyl, wherein alkyl represents a group that contains from about 12 to about 24 carbon atoms which may be branched or straight chained and which may be saturated or unsaturated. Representative long chain alkyl groups include tetradecyl (myristyl), hexadecyl (cetyl), octadecentyl (oleyl), octadecyl (stearyl), docosenoic (erucyl) and the derivatives of tallow, coco, soya and rapeseed oils. The preferred alkyl and alkenyl groups are alkyl and alkenyl groups having from about 16 to about 22 carbon atoms. Representative of alkylamidoalkyl is alkylamidopropyl with alkyl being as described above.

$R_2$ and $R_3$ are independently an aliphatic chain (i.e. as opposed to aromatic at the atom bonded to the quaternary nitrogen, e.g., alkyl, alkenyl, arylalkyl, hydroxyalkyl, carboxyalkyl, and hydroxyalkyl-polyoxyalkylene, e.g. hydroxyethyl-polyoxyethylene or hydroxypropyl-polyoxypropylene) having from 1 to about 30 atoms, preferably from about 1 to about 20 atoms, more preferably from about 1 to about 10 atoms and most preferably from about 1 to about 6 atoms in which the aliphatic group can be branched or straight chained, saturated or unsaturated. Preferred alkyl chains are methyl, ethyl, preferred arylalkyl is benzyl, and preferred hydroxyalkyls are hydroxyethyl or hydroxypropyl, while preferred carboxyalkyls are acetate and propionate.

R4 is a hydrocarbyl radical (e.g. alkylene) with chain length 1 to 4. Preferred are methylene or ethylene groups.

Specific examples of zwitterionic surfactants include the following structures:

II

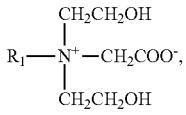

III

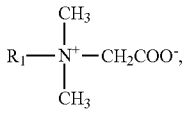

IV

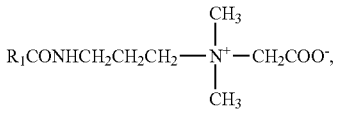

V

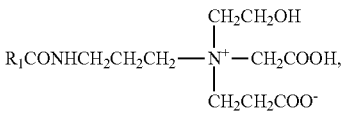

wherein $R_1$ has been previously defined herein.

Examples of amphoteric surfactants include those represented by formula VI:

VI

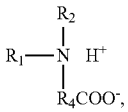

wherein $R_1$, $R_2$, and $R_4$ are the same as defined above.

Other specific examples of amphoteric surfactants include the following structures:

VII

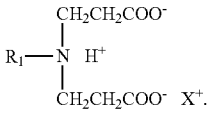

VIII

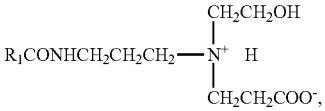

wherein $R_1$ has been previously defined herein, and $X^+$ is an inorganic cation such as $Na^+$, $K^+$, $NH_4^+$ associated with a carboxylate group or hydrogen atom in an acidic medium.

Suitable viscoelastic surfactants may comprise mixtures of several different compounds, including but not limited to: mixtures of an ammonium salt of an alkyl ether sulfate, a cocoamidopropyl betaine surfactant, a cocoamidopropyl dimethylamine oxide surfactant, sodium chloride, and water; mixtures of an ammonium salt of an alkyl ether sulfate surfactant, a cocoamidopropyl hydroxysultaine surfactant, a cocoamidopropyl dimethylamine oxide surfactant, sodium chloride, and water; mixtures of an ethoxylated alcohol ether sulfate surfactant, an alkyl or alkene amidopropyl betaine surfactant, and an alkyl or alkene dimethylamine oxide surfactant; aqueous solutions of an alpha-olefinic sulfonate surfactant and a betaine surfactant; and combinations thereof. Examples of suitable mixtures of an ethoxylated alcohol ether sulfate surfactant, an alkyl or alkene amidopropyl betaine surfactant, and an alkyl or alkene dimethylamine oxide surfactant are described in U.S. Pat. No. 6,063,738, the relevant disclosure of which is incorporated herein by reference. Examples of suitable aqueous solutions of an alpha-olefinic sulfonate surfactant and a betaine surfactant are described in U.S. Pat. No. 5,879,699, the relevant disclosure of which is incorporated herein by reference. Suitable viscoelastic surfactants also may comprise "catanionic" surfactant systems, which comprise paired oppositely-charged surfactants that act as counterions to each other and may form wormlike micelles. Examples of such catanionic surfactant systems include, but are not limited to sodium oleate (NaO)/octyl trimethylammonium chloride ($C_8$TAC) systems, stearyl trimethylammonium chloride ($C_{18}$TAC)/caprylic acid sodium salt (NaCap) systems, and cetyl trimethylammonium tosylate (CTAT)/sodium dodecylbenzenesulfonate (SDBS) systems.

Examples of commercially-available viscoelastic surfactants suitable for use in the present invention may include, but are not limited to, Mirataine BET-O 30™ (an oleamidopropyl betaine surfactant available from Rhodia Inc., Cranbury, N.J.), DV-8829 a erucicdimethylamidopropylbetaine $C_{29}H_{57}N_2O_3^-$ Surfactant available from Rhodia Inc., Cranbury, N.J., Aromox APA-T (amine oxide surfactant available from Akzo Nobel Chemicals, Chicago, Ill.), Ethoquad O/12 PG™ (a fatty amine ethoxylate quat surfactant available from Akzo Nobel Chemicals, Chicago, Ill.), Ethomeen T/12™ (a fatty amine ethoxylate surfactant available from Akzo Nobel Chemicals, Chicago, Ill.), Ethomeen S/12™ (a fatty amine ethoxylate surfactant available from Akzo Nobel Chemicals, Chicago, Ill.), and Rewoteric AM TEG™ (a tallow dihydroxyethyl betaine amphoteric surfactant available from Degussa Corp., Parsippany, N.J.).

Typical chemical processes for synthesizing viscoelastic surfactants are disclosed in U.S. Pat. No. 6,258,858 the disclosure of which is herein incorporated by reference.

The viscoelastic surfactant is present in the cleaning compositions in an amount sufficient to impart the desired viscosity to the composition. In certain embodiments, the viscoelastic surfactant may be present in an amount in the range of from about 0.1% to about 20% by weight of the cleaning composition. In certain embodiments, the viscoelastic surfactant may be present in an amount in the range of from about 0.5% to about 10% by weight of the cleaning compositing. In certain embodiments, the viscoelastic surfactant may be present in an amount in the range of from about 0.5% to about 3% by weight of the cleaning composition.

According to the invention, viscoelastic cleaning compositions are disclosed which do not rely upon polymer thickening agents for their viscoelasticity. The invention employs the use of viscoelastic surfactants in several cleaning composition formulations. These provide the dual benefit of thickening as well as an additional cleaning component, improving performance.

In one embodiment, the cleaning compositions comprise an acid constituent, the viscoelastic surfactant of erucicdimethylamidopropylbetaine $C_{29}H_{57}N_2O_3$, and a polar carrier such as water.

Cleaning compositions are disclosed at neutral or alkaline pH with the use of viscoelastic surfactants, combined with an appropriate pseudo linking agent. Thus the invention includes a neutral or alkaline cleaning composition comprising a source of alkalinity, a viscoelastic surfactant and a pseudo linker.

In addition to erucicdimethylamidopropylbetaine $C_{29}H_{57}N_2O_3$, other viscoelastic surfactants such as amphoteric surfactants, zwitterionic surfactants, such as dicarboxylic coconut derived sodium salt (Miranol C2M-SF), cocamidopropyl dimethylamine (Mackine GO-163), cocoamidopropyl betaine, and alkylether hydroxypropyl sultaine (Mirataine ASC), and amine oxide and mixtures thereof can be used in neutral or preferably alkaline conditions with the use of an effective pseudo linking agent. Additional viscoelastic surfactants are also contemplated as these viscoelastic surfactants all have a charge separation on the surfactant molecule, thus it is believed that other viscoelastic surfactants by be used according to the invention, including for example sultaine-type surfactants.

According to the invention, a pseudo linker agent may be used with the viscoelastic surfactant under alkaline or neutral conditions to impart viscoelasticity to the solution. Examples of suitable pseudo linkers include multiply charged cations, such as $Mg^{2+}$, anionic surfactants such as sodium lauryl ether sulfate (SLES), Linear Alkyl Sodium Sulfonates (LAS) and neutralized Etidronic acid (dequest 2010) Diethylene triamine pentaacetic acid (DTPA). According to the invention, the ratio of active surfactant to active pseudo linker is in a ratio of linker to active viscoelastic surfactant of greater than 1:1 by percent weight of active components.

Thus the invention comprises, an alkaline or neutral cleaning composition comprising from about 3% by weight to about 15% by weight of a viscoelastic surfactant; from about 0.1 to about 30% by weight of a pseudo linker, and from about 0.5 to 15% of a source of alkalinity.

Alkalinity Source

The cleaning composition also includes an alkalinity source, such as an alkali metal hydroxide, alkali metal carbonate, or alkali metal silicate. Examples of suitable alkalinity sources include, but are not limited to: sodium hydroxide, potassium hydroxide, sodium carbonate, potassium carbonate or a mixture of alkali metal hydroxide and alkali metal carbonate. The alkalinity source controls the pH of the resulting solution when water is added to the cleaning composition to form a use solution. The pH of the use solution must be maintained in the alkaline range in order to provide sufficient detergency properties. In an embodiment, the pH of the solution is between approximately 9 and approximately 14.

Particularly, the pH of the use solution is between about 10 and about 12. More particularly, the pH of the use solution is between about 11 and about 12. If the pH of the use solution is too low, for example, below approximately 9, the use solution may not provide adequate detergency properties. If the pH of the use solution is too high, for example, above approximately 12, the use solution may be too alkaline and attack or damage the surface.

As can be seen from the examples herein, particularly in alkaline conditions, a fairly large amount of the viscoelastic surfactant is required to achieve high levels of viscoelasticity. Additionally, in alkaline conditions, there is an adverse affect from the addition of caustic that needs to be overcome.

Pseudo Linkers

Pseudo-linkers increase the viscoelasticity of the surfactant system. It is believed that this pseudo cross linking works through the charge interaction between the pseudo cross linker and the viscoelastic surfactant. Examples of suitable pseudo linkers include simple salts, anionic surfactants and cationic surfactants.

Depending on the pH of the formulation, some pseudo linkers will work better than others. For example, under acidic conditions, the betaine-type viscoelastic surfactants will be more protonated than in neutral or alkaline conditions. Therefore, a pseudo cross linker that will take advantage of the positive quaternary ammonium group will be preferred. In alkaline conditions, the opposite is the case, and pseudo linkers with stronger cationic properties, such as $MgCl_2$, will be preferred.

Examples of acceptable pseudo linkers include simple salts, multiply charged cations or anions, especially those that are multi-functional, for examples, providing alkalinity, or chelation.

(I) Simple Salts:

One example of a useful pseudo linker includes one or more simple salts, for example, an alkali metal salt. The alkali metal salt can also act as an alkalinity source to enhance cleaning of a substrate, and improve soil removal performance of the composition. Some examples of alkali metal salts include alkali metal carbonates, silicates, phosphonates, sulfates, borates, or the like, and mixtures thereof. Alkali metal carbonates are more preferred, and some examples of preferred carbonate salts include alkali metal carbonates such as sodium or potassium carbonate, bicarbonate, sesquicarbonate, mixtures thereof, and the like; preferably sodium carbonate, potassium carbonate, or mixtures thereof. Particularly preferred salts are those with divalent cations. Preferred salts for use as pseudo linkers include but are not limited to $MgSO_4$, Mg acetate, Al sulfate, EDTA (Versene 100), DTPA (Hamp-ex 80), STPP, neutralized ATMP (neutralized Dequest 2000), neutralized HEDP (neutralized Dequest 2010), neutralized Bayhibit AM, etc.

(II) Anionic Surfactants

Anionic organic surfactants useful as pseudo linkers include linear alkyl benzene sulfonates containing from about 10 to about 18 carbon atoms in the alkyl group; branched alkyl benzene sulfonates containing from about 10 to about 18 carbon atoms in the alkyl group; the tallow range alkyl sulfates; the coconut range alkyl glyceryl sulfonates; alkyl ether (ethoxylated) sulfates wherein the alkyl moiety contains from about 12 to 18 carbon atoms and wherein the average degree of ethoxylation varies between 1 and 12, especially 3 to 9; the sulfated condensation products of tallow alcohol with from about 3 to 12, especially 6 to 9, moles of ethylene oxide; and olefin sulfonates containing from about 14 to 16 carbon atoms.

Specific preferred anionics for use herein include: the linear $C_{10}$-$C_{14}$ alkyl benzene sulfonates (LAS); the branched $C_{10}$-$C_{14}$ alkyl benzene sulfonates (ABS); the tallow alkyl sulfates, the coconut alkyl glyceryl ether sulfonates; the sulfated condensation products of mixed $C_{10}$-$C_{18}$ tallow alcohols with from about 1 to about 14 moles of ethylene oxide; and the mixtures of higher fatty acids containing from 10 to 18 carbon atoms. Particularly preferred are NaLAS, NaLES (lipid extract surfactant, Dowfax Hydrotrope (diphenyloxide disulfonic acid-based surfactant), SXS (Sodium xylene sulfonate) ethoxylated PEI and the like.

(III) Cationic Surfactants

Cationic surfactants useful for inclusion in a cleaning composition as pseudo linkers include amines such as primary, secondary and tertiary monoamines with $C_{18}$ alkyl or alkenyl chains, ethoxylated alkylamines, alkoxylates of ethylenediamine, imidazoles such as a 1-(2-hydroxyethyl)-2-imidazoline, a 2-alkyl-1-(2-hydroxyethyl)-2-imi-dazoline, and the like; and quaternary ammonium salts, as for example, alkylquatemary ammonium chloride surfactants such as n-alkyl($C_{12}$-$C_{18}$)dimethylbenzyl ammonium chloride, n-tetradecyl dimethylbenzylammonium chloride monohydrate, a naphthylene-substituted quaternary ammonium chloride such as dimethyl-1-naphthylmethylammonium chloride, and the like; and other like cationic surfactants. Particularly preferred is trimethyl alkyl quaternary ammonium chloride.

The pseudo linker is provided in an amount sufficient to impart viscoelasticity to the composition in the presence of the viscoelastic surfactant. As can be seen this is typically a ratio greater than 1:1 of active percent by weight of linker to active percent by weight of surfactant. The range can be from 0.1 wt. % to about 2 wt. % of active surfactant to 0.2 wt. % to about 5% by weight of pseudo linker.

Additional Materials

The compositions may also include additional materials, such as additional functional materials, for example enzymes, enzyme stabilizing system, additional surfactant, chelating agents, sequestering agents, bleaching agents, additional thickening agent, solubility modifier, detergent filler, defoamer, anti-redeposition agent, a threshold agent or system, aesthetic enhancing agent (i.e. dye, perfume, etc.) and the like, or combinations or mixtures thereof. Adjuvants and other additive ingredients will vary according to the type of composition being manufactured and can be included in the compositions in any amount. The following is a brief discussion of some examples of such additional materials.

Enzymes

The composition of the invention may include one or more enzymes, which can provide desirable activity for removal of protein-based, carbohydrate-based, or triglyceride-based stains from substrates; for cleaning, destaining, and sanitizing presoaks, such as presoaks for flatware, cups and bowls, and pots and pans; presoaks for medical and dental instruments; or presoaks for meat cutting equipment; for machine warewashing; for laundry and textile cleaning and destaining; for carpet cleaning and destaining; for cleaning-in-place and destaining-in-place; for cleaning and destaining food processing surfaces and equipment; for drain cleaning; presoaks for cleaning; and the like. Enzymes may act by degrading or altering one or more types of soil residues encountered on a surface or textile thus removing the soil or making the soil more removable by a surfactant or other component of the cleaning composition. Both degradation and alteration of soil residues can improve detergency by reducing the physicochemical forces which bind the soil to the surface or textile being cleaned, i.e. the soil becomes more water soluble. For example, one or more proteases can cleave complex, macromolecular protein structures present in soil residues into simpler short chain molecules which are, of themselves, more readily desorbed from surfaces, solubilized or otherwise more easily removed by detersive solutions containing said proteases.

Suitable enzymes may include a protease, an amylase, a lipase, a gluconase, a cellulase, a peroxidase, or a mixture thereof of any suitable origin, such as vegetable, animal, bacterial, fungal or yeast origin. Selections are influenced by factors such as pH-activity and/or stability optima, thermostability, and stability to active detergents, builders and the like. In this respect bacterial or fungal enzymes may be preferred, such as bacterial amylases and proteases, and fungal cellulases. Preferably the enzyme may be a protease, a lipase, an amylase, or a combination thereof. Enzyme may be present in the composition from at least 0.01 wt %, or 0.01 to 2 wt %.

Enzyme Stabilizing System

The composition of the invention may include an enzyme stabilizing system. The enzyme stabilizing system can include a boric acid salt, such as an alkali metal borate or amine (e. g. an alkanolamine) borate, or an alkali metal borate, or potassium borate. The enzyme stabilizing system can also include other ingredients to stabilize certain enzymes or to enhance or maintain the effect of the boric acid salt.

For example, the cleaning composition of the invention can include a water soluble source of calcium and/or magnesium ions. Calcium ions are generally more effective than magnesium ions and are preferred herein if only one type of cation is being used. Cleaning and/or stabilized enzyme cleaning compositions, especially liquids, may include 1 to 30, 2 to 20, or 8 to 12 millimoles of calcium ion per liter of finished composition, though variation is possible depending on factors including the multiplicity, type and levels of enzymes incorporated. Water-soluble calcium or magnesium salts may be employed, including for example calcium chloride, calcium hydroxide, calcium formate, calcium malate, calcium maleate, calcium hydroxide and calcium acetate; more generally, calcium sulfate or magnesium salts corresponding to the listed calcium salts may be used. Further increased levels of calcium and/or magnesium may of course be useful, for example for promoting the grease-cutting action of certain types of surfactant.

Stabilizing systems of certain cleaning compositions, for example warewashing stabilized enzyme cleaning compositions, may further include 0 to 10%, or 0.01% to 6% by weight, of chlorine bleach scavengers, added to prevent chlorine bleach species present in many water supplies from attacking and inactivating the enzymes, especially under alkaline conditions. While chlorine levels in water may be small, typically in the range from about 0.5 ppm to about 1.75 ppm, the available chlorine in the total volume of water that comes in contact with the enzyme, for example during warewashing, can be relatively large; accordingly, enzyme stability to chlorine in-use can be problematic.

Suitable chlorine scavenger anions are known and readily available, and, if used, can be salts containing ammonium cations with sulfite, bisulfite, thiosulfite, thiosulfate, iodide, etc. Antioxidants such as carbamate, ascorbate, etc., organic amines such as ethylenediaminetetracetic acid (EDTA) or alkali metal salt thereof, monoethanolamine (MEA), and mixtures thereof can likewise be used.

Additional Surfactants

Additional surfactants may be present in some compositions embodying the invention. The surfactant or surfactant admixture can be selected from nonionic, semi-polar nonionic, anionic, cationic, amphoteric, or zwitterionic surface-active agents; or any combination thereof. In at least some embodiments, the surfactants are water soluble or water dispersible. The particular surfactant or surfactant mixture chosen for use in the process and products of this invention can depend on the conditions of final utility, including method of manufacture, physical product form, use pH, use temperature, foam control, and soil type. For a discussion of surfactants, see Kirk-Othmer, Encyclopedia of Chemical Technology, Third Edition, volume 8, pages 900-912. The composition may include a surfactant in an amount effective to provide a desired level of cleaning, such as 0-20 wt %, or 1.5-15 wt %.

Anionic surfactants may include, for example, carboxylates such as alkylcarboxylates (carboxylic acid salts) and polyalkoxycarboxylates, alcohol ethoxylate carboxylates, nonylphenol ethoxylate carboxylates, and the like; sulfonates such as alkylsulfonates, alkylbenzenesulfonates, alkylarylsulfonates, sulfonated fatty acid esters, and the like; sulfates such as sulfated alcohols, sulfated alcohol ethoxylates, sulfated alkylphenols, alkylsulfates, sulfosuccinates, alkylether sulfates, and the like; and phosphate esters such as alkylphosphate esters, and the like.

Nonionic surfactants may include those having a polyalkylene oxide polymer as a portion of the surfactant molecule. Such nonionic surfactants include, for example, chlorine-, benzyl-, methyl-, ethyl-, propyl-, butyl- and other like alkyl-capped polyethylene glycol ethers of fatty alcohols; polyalkylene oxide free nonionics such as alkyl polyglycosides; sorbitan and sucrose esters and their ethoxylates; alkoxylated ethylene diamine; alcohol alkoxylates such as alcohol ethoxylate propoxylates, alcohol propoxylates, alcohol propoxylate ethoxylate propoxylates, alcohol ethoxylate butoxylates, and the like; nonylphenol ethoxylate, polyoxyethylene glycol ethers and the like; carboxylic acid esters such as glycerol esters, polyoxyethylene esters, ethoxylated and glycol esters of fatty acids, and the like; carboxylic amides such as diethanolamine condensates, monoalkanolamine condensates, polyoxyethylene fatty acid amides, and the like; and polyalkylene oxide block copolymers including an ethylene oxide/propylene oxide block copolymer such as those commercially available under the trademark PLURONIC™ (BASF-Wyandotte), and the like; and other like nonionic compounds. Silicone surfactants such as the ABIL™ B8852 can also be used.

Cationic surfactants useful for inclusion in a cleaning composition for sanitizing or fabric softening, include amines such as primary, secondary and tertiary monoamines with $C_{18}$ alkyl or alkenyl chains, ethoxylated alkylamines, alkoxylates of ethylenediamine, imidazoles such as a 1-(2-hydroxyethyl)-2-imidazoline, a 2-alkyl-1-(2-hydroxyethyl)-2-imi-dazoline, and the like; and quaternary ammonium salts, as for example, alkylquatemary ammonium chloride surfactants such as n-alkyl($C_{12}$-$C_{18}$)dimethylbenzyl ammonium chloride, n-tetradecyl dimethylbenzylammonium chloride monohydrate, a naphthylene-substituted quaternary ammonium chloride such as dimethyl-1-naphthylmethylammonium chloride, and the like; and other like cationic surfactants.

Chelating/Sequestering Agent

The composition may include a chelating/sequestering agent such as an aminocarboxylic acid, a condensed phosphate, a phosphonate, a polyacrylate, and the like. In general, a chelating agent is a molecule capable of coordinating (i.e., binding) the metal ions commonly found in natural water to prevent the metal ions from interfering with the action of the other detersive ingredients of a cleaning composition. The chelating/sequestering agent may also function as a threshold agent when included in an effective amount. The composition may include 0.1-70 wt %, or 5-60 wt %, of a chelating/sequestering agent. An iminodisuccinate (available commercially from Bayer as IDS™) may be used as a chelating agent.

Useful aminocarboxylic acids include, for example, N-hydroxyethyliminodiacetic acid, nitrilotriacetic acid (NTA), ethylenediaminetetraacetic acid (EDTA), N-hydroxyethyl-ethylenediaminetri-acetic acid (HEDTA), diethylenetriaminepentaacetic acid (DTPA), and the like.

Examples of condensed phosphates useful in the present composition include sodium and potassium orthophosphate, sodium and potassium pyrophosphate, sodium tripolyphosphate, sodium hexametaphosphate, and the like.

The composition may include a phosphonate such as 1-hydroxyethane-1,1-diphosphonic acid and the like.

Polymeric polycarboxylates may also be included in the composition. Those suitable for use as cleaning agents have pendant carboxylate groups and include, for example, polyacrylic acid, maleic/olefin copolymer, acrylic/maleic copolymer, polymethacrylic acid, acrylic acid-methacrylic acid copolymers, hydrolyzed polyacrylamide, hydrolyzed polymethacrylamide, hydrolyzed polyamide-methacrylamide copolymers, hydrolyzed polyacrylonitrile, hydrolyzed polymethacrylonitrile, hydrolyzed acrylonitrile-methacrylonitrile copolymers, and the like. For a further discussion of chelating agents/sequestrants, see Kirk-Othmer, Encyclopedia of Chemical Technology, Third Edition, volume 5, pages 339-366 and volume 23, pages 319-320, the disclosure of which is incorporated by reference herein.

Bleaching Agents

Bleaching agents for lightening or whitening a substrate, include bleaching compounds capable of liberating an active halogen species, such as $Cl_2$, $Br_2$, —$OCl^-$ and/or —$OBr^-$, under conditions typically encountered during the cleansing process. Suitable bleaching agents include, for example, chlorine-containing compounds such as a chlorine, a hypochlorite, chloramine. Halogen-releasing compounds may include the alkali metal dichloroisocyanurates, chlorinated trisodium phosphate, the alkali metal hypochlorites, monochloramine and dichloramine, and the like. Encapsulated chlorine sources may also be used to enhance the stability of the chlorine source in the composition (see, for example, U.S. Pat. Nos. 4,618,914 and 4,830,773, the disclosure of which is incorporated by reference herein). A bleaching agent may also be a peroxygen or active oxygen source such as hydrogen peroxide, perborates, sodium carbonate peroxyhydrate, phosphate peroxyhydrates, potassium permonosulfate, and sodium perborate mono and tetrahydrate, with and without activators such as tetraacetylethylene diamine, and the like. A cleaning composition may include a minor but effective amount of a bleaching agent, such as 0.1-10 wt %, or 1-6 wt %.

Detergent Builders or Fillers

A composition may include a minor but effective amount of one or more of a detergent filler which does not perform as a cleaning agent per se, but cooperates with the cleaning agent to enhance the overall cleaning capacity of the composition. Examples of fillers suitable for use in the present cleaning compositions include sodium sulfate, sodium chloride, starch, sugars, $C_1$-$C_{10}$ alkylene glycols such as propylene glycol, and the like. Inorganic or phosphate-containing detergent builders may include alkali metal, ammonium and alkanolammonium salts of polyphosphates (e.g. tripolyphosphates, pyrophosphates, and glassy polymeric meta-phosphates). Non-phosphate builders may also be used. A detergent filler may be included in an amount of 1-20 wt %, or 3-15 wt %.

Defoaming Agents

A minor but effective amount of a defoaming agent for reducing the stability of foam may also be included in the compositions. The cleaning composition can include 0.01-5 wt % of a defoaming agent, or 0.01-3 wt %.

Examples of defoaming agents include silicone compounds such as silica dispersed in polydimethylsiloxane, fatty amides, hydrocarbon waxes, fatty acids, fatty esters, fatty alcohols, fatty acid soaps, ethoxylates, mineral oils, polyethylene glycol esters, alkyl phosphate esters such as monostearyl phosphate, and the like. A discussion of defoaming agents may be found, for example, in U.S. Pat. No. 3,048,548 to Martin et al., U.S. Pat. No. 3,334,147 to Brunelle et al., and U.S. Pat. No. 3,442,242 to Rue et al., the disclosures of which are incorporated by reference herein.

Anti-Redeposition Agents

The composition may include an anti-redeposition agent capable of facilitating sustained suspension of soils in a cleaning solution and preventing the removed soils from being redeposited onto the substrate being cleaned. Examples of suitable anti-redeposition agents include fatty acid amides, fluorocarbon surfactants, complex phosphate esters, styrene maleic anhydride copolymers, and cellulosic derivatives such as hydroxyethyl cellulose, hydroxypropyl cellulose, and the like. The composition may include 0.5-10 wt %, or 1-5 wt %, of an anti-redeposition agent.

Dyes/Odorants

Various dyes, odorants including perfumes, and other aesthetic enhancing agents may also be included in the composition. Dyes may be included to alter the appearance of the composition, as for example, Direct Blue 86 (Miles), Fastusol Blue (Mobay Chemical Corp.), Acid Orange 7 (American Cyanamid), Basic Violet 10 (Sandoz), Acid Yellow 23 (GAF), Acid Yellow 17 (Sigma Chemical), Sap Green (Keyston Analine and Chemical), Metanil Yellow (Keystone Analine and Chemical), Acid Blue 9 (Hilton Davis), Sandolan Blue/Acid Blue 182 (Sandoz), Hisol Fast Red (Capitol Color and Chemical), Fluorescein (Capitol Color and Chemical), Acid Green 25 (Ciba-Geigy), and the like.

Fragrances or perfumes that may be included in the compositions include, for example, terpenoids such as citronellol, aldehydes such as amyl cinnamaldehyde, a jasmine such as CIS-jasmine or jasmal, vanillin, and the like.

Divalent Ion

The compositions of the invention may contain a divalent ion, selected from calcium and magnesium ions, at a level of from 0.05% to 5% by weight, or from 0.1% to 1% by weight, or 0.25% by weight of the composition. The divalent ion can be, for example, calcium or magnesium. The calcium ions can, for example, be added as a chloride, hydroxide, oxide, formate, acetate, nitrate salt.

Polyol

The composition of the invention can also include a polyol. The polyol may provide additional stability and hydrotrophic properties to the composition. Propylene glycol and sorbitol are examples of some suitable polyols.

The compositions of the invention may also contain additional typically nonactive materials, with respect to cleaning properties, generally found in liquid pretreatment or detergent compositions in conventional usages. These ingredients are selected to be compatible with the materials of the invention and include such materials as fabric softeners, optical brighteners, soil suspension agents, germicides, viscosity modifiers, inorganic carriers, solidifying agents and the like.

Additional Thickening Agent

In some embodiments, it is contemplated that an additional thickening agent may be included, however, in many embodiments, it is not required. Some examples of additional thickeners include soluble organic or inorganic thickener material. Some examples of inorganic thickeners include clays, silicates and other well-known inorganic thickeners. Some examples of organic thickeners include thixotropic and non-thixotropic thickeners. In some embodiments, the thickeners have some substantial proportion of water solubility to promote easy removability. Examples of useful soluble organic thickeners for the compositions of the invention comprise carboxylated vinyl polymers such as polyacrylic acids and sodium salts thereof, ethoxylated cellulose, polyacrylamide thickeners, xanthan thickeners, guargum, sodium alginate and algin by-products, hydroxy propyl cellulose, hydroxy ethyl cellulose and other similar aqueous thickeners that have some substantial proportion of water solubility.

Methods of Making the Compositions

The compositions according to the invention are easily produced by any of a number of known art techniques. Conveniently, a part of the water is supplied to a suitable mixing vessel further provided with a stirrer or agitator, and while stirring, the remaining constituents are added to the mixing vessel, including any final amount of water needed to provide to 100% wt. of the inventive composition.

The compositions may be packaged in any suitable container particularly flasks or bottles, including squeeze-type bottles, as well as bottles provided with a spray apparatus (e.g. trigger spray) which is used to dispense the composition by spraying. Accordingly the compositions are desirably provided as a ready to use product in a manually operated spray dispensing container, or may be supplied in aerosolized product wherein it is discharged from a pressurized aerosol container. Propellants which may be used are well known and conventional in the art and include, for example, a hydrocarbon, of from 1 to 10 carbon atoms, such as n-propane, n-butane, isobutane, n-pentane, isopentane, and mixtures thereof; dimethyl ether and blends thereof as well as individual or mixtures of chloro-, chlorofluoro- and/or fluorohydrocarbons- and/or hydrochlorofluorocarbons (HCFCs). Useful commercially available compositions include A-70 (Aerosol compositions with a vapor pressure of 70 psig available from companies such as Diversified and Aeropress) and Dyme® 152a (1, 1-difluoroethane from DuPont). Compressed gases such as carbon dioxide, compressed air, nitrogen, and possibly dense or supercritical fluids may also be used. In such an application, the composition is dispensed by activating the release nozzle of said aerosol type container onto the area in need of treatment, and in accordance with a manner as above-described the area is treated (e.g., cleaned and/or sanitized and/or disinfected). If a propellant is used, it will generally be in an amount of from about 1% to about 50% of the aerosol formulation with preferred amounts being from about 2% to about 25%, more preferably from about 5% to about 15%. Generally speaking, the amount of a particular propellant employed should provide an internal pressure of from about 20 to about 150 psig at 70° F.

Preferably, the composition is adapted for being dispensed using a trigger spray. Alternately, preferably, the composition is adapted for being dispensed using a squeeze bottle through a nozzle.

The compositions according to the invention can also be suited for use in a consumer "spray and wipe" application as a cleaning composition. In such an application, the consumer generally applies an effective amount of the composition using the pump and within a few moments thereafter, wipes off the treated area with a cloth, towel, or sponge, usually a disposable paper towel or sponge. In certain applications, however, especially where undesirable stain deposits are heavy, such as grease stains the cleaning composition according to the invention may be left on the stained area until it has effectively loosened the stain deposits after which it may then be wiped off, rinsed off, or otherwise removed. For particularly heavy deposits of such undesired stains, multiple applications may also be used. Optionally, after the composition has remained on the surface for a period of time, it could be rinsed or wiped from the surface. Due to the viscoelasticity of the compositions, the cleaning compositions have improved cling and remain for extended periods of time even on vertical surfaces.

Whereas the compositions of the present invention are intended to be used in the types of liquid forms described, nothing in this specification shall be understood as to limit the use of the composition according to the invention with a further amount of water to form a cleaning solution there from. In such a proposed diluted cleaning solution, the greater the proportion of water added to form said cleaning dilution will, the greater may be the reduction of the rate and/or efficacy of the thus formed cleaning solution. Accordingly, longer residence times upon the stain to affect their loosening and/or the usage of greater amounts may be necessitated. Preferred dilution ratios of the concentrated hard surface cleaning composition: water of 1:1-100, preferably 1:2-100, more preferably 1:3-100, yet more preferably 1:10-100, and most preferably 1:16-85, on either a weight/weight ("w/w") ratio or alternately on a volume/volume ("v/v") ratio.

Conversely, nothing in the specification shall be also understood to limit the forming of a "super-concentrated" cleaning composition based upon the composition described above. Such a super-concentrated ingredient composition is essentially the same as the cleaning compositions described above except in that they include a lesser amount of water.

The compositions of the present invention, whether as described herein or in diluted, a concentrate or a super concentrate form, can also be applied to a hard surface by the use of a carrier substrate. One example of a useful carrier substrate is a wet wipe. The wipe can be of a woven or non-woven nature. Fabric substrates can include non-woven or woven pouches, sponges including both closed cell and open celled sponges, including sponges formed from celluloses as well as other polymeric material, as well as in the form of abrasive or non-abrasive cleaning pads. Such fabrics are known commercially in this field and are often referred to as wipes. Such substrates can be resin bonded, hydroentangled, thermally bonded, meltblown, needlepunched, or any combination of the former. The carrier substrate useful with the present inventive compositions may also be a wipe which includes a film forming substrate such as a water soluble polymer. Such self-supporting film substrates may be sandwiched between layers of fabric substrates and heat sealed to form a useful substrate.

The compositions of the present invention are advantageously absorbed onto the carrier substrate, i.e., a wipe to form a saturated wipe. The wipe can then be sealed individually in a pouch which can then be opened when needed or a multitude of wipes can be placed in a container for use on an as needed basis. The container, when closed, sufficiently sealed to prevent evaporation of any components from the compositions. In use, a wipe is removed from the container and then wiped across an area in need of treatment; in case of difficult to treat stains the wipe may be re-wiped across the area in need of treatment, or a plurality of saturated wipes may also be used.

Additionally, it is also contemplated that a viscoelastic surfactant/psuedo linker combination can be used as a thickening medium alone and added to an appropriate cleaning composition, as described above.

Methods of Cleaning

The present invention also relates to methods of cleaning a soiled object. This embodiment of the method can include contacting the object with a neutral or alkaline cleaning composition. The cleaning steps can be provided in a number of ways depending on the specific formulation. In an embodiment, the method can include contacting the object with a viscoelastic cleaning composition according to the in any of a number of for a predetermined time; and after passage of the predetermined time, rising the cleaning composition from the object so that the cleaning composition and any soils or debris are washed away. The method can be employed to clean any of a variety of objects. In an embodiment, the soiled object includes or is pipes or vessels in a food processing plant, wares, laundry, an oven, a grill, or a floor, a carpet, a medical device.

The present invention will now be further illustrated by way of the following non-limiting examples, in which parts and percentages are by weight unless otherwise indicated.

EXAMPLES

Of the test methods specified by these references to determine whether a liquid possesses viscoelastic properties, one test which has been found to be useful in determining the viscoelasticity of an aqueous solution consists of swirling the solution and visually observing whether the bubbles created by the swirling recoil after the swirling is stopped. Any recoil of the bubbles indicates viscoelasticity. Another useful test is to measure the storage modulus (G') and the loss modulus (G") at a given temperature. If G'>G" at some point or over some range of points below about 10 rad/sec, typically between about 0.001 to about 10 rad/sec, more typically between about 0.1 and about 10 rad/sec, at a given temperature and if G'>10.sup.-2 Pascals, preferably 10.sup.-1 Pascals, the fluid is typically considered viscoelastic at that temperature. Rheological measurements such as G' and G" are discussed more fully in "Rheological Measurements", Encyclopedia of Chemical Technology, vol. 21, pp.

347-372, (John Wiley & Sons, Inc., N.Y., N. Y., 1997, 4th ed.). To the extent necessary for completion, the above disclosures are expressly incorporated herein by reference.

Viscoelasticity Test

A study was performed to measure the viscoelasticity of exemplary wetting agent compositions of the present invention and comparative compositions. Without wishing to be bound by any particular theory, it is thought that the thin-film viscoelasticity of a solution is related to the overall sheeting, draining and drying of the solution on the substrates to which they are applied. It is thought that a certain elasticity is important for the liquid to generally hold the "sheets." However, too high a level of elasticity can hinder drainage and drying of the rinse aid from the substrate.

The viscoelasticity measurements for this study were taken using a Bohlin CVO 120 HR NF Rheometer. The measurements were taken for neat or high concentration solutions (in case the 100% material is a solid at room temperature) of individual surfactants, and combinations of surfactants. The measurements are measured in the linear viscoelastic range. The data plotted were G' and G" versus strain. G' is the elastic component of the complex modulus, and G" is the viscous component of the complex modulus. The association effect of the surfactant molecules was studied. The results of this study are shown in the figures herewith. In these figures, the x-axis depicts the strain. In this example, strain is a ratio of two lengths and has no units. It is defined by the formula shown below:

$$\text{Shear strain}=\Delta u/h.$$

In these figures, the y-axis is shows units of pascal ("Pa"). The pascal is the SI derived unit of pressure, stress, Young's Modulus and tensile stress. It is a measure of force per unit area, i.e., equivalent to one newton per square meter.

Example 1: Creation of Viscoelastic Formulas Utilizing Viscoelastic Surfactants in an Acidic, Neutral and Alkaline pH DV-8829 a viscoelastic surfactant of erucicdimethylamidopropylbetaine $C_{29}H_{57}N_2O_3$ available from Rhodia Inc., Cranbury, N.J.

Varying concentrations of the DV-8829 surfactant were used to determine the amount required to achieve a viscoelastic formula in an commercial acidic clinging lime removal composition comprising sulfuric acid, urea, and pluronic. DV-8829 was used at concentrations of 15, 10, 5.5 3 percent by weight of the composition. At higher than 10% by weight of VD-8829 the compositing became too viscous. At 10% by weight the solution was extremely thick. Very high levels of viscoelasticity were achieved in acidic conditions. Increasing the concentration of viscoelastic surfactant increased the viscoelasticity of the formula in acidic systems.

Experiments were also performed to determine if viscoelasticity can be achieved in formulas with a neutral pH in a cleaning formulation comprising a detersive solution of alkyl polyglycosides based on a natural fatty alcohol C8-C10 with DV-8829 at 45% by weight of actives and water. The results showed that high levels of viscoelasticity were achieved in neutral conditions.

Figure 1B:
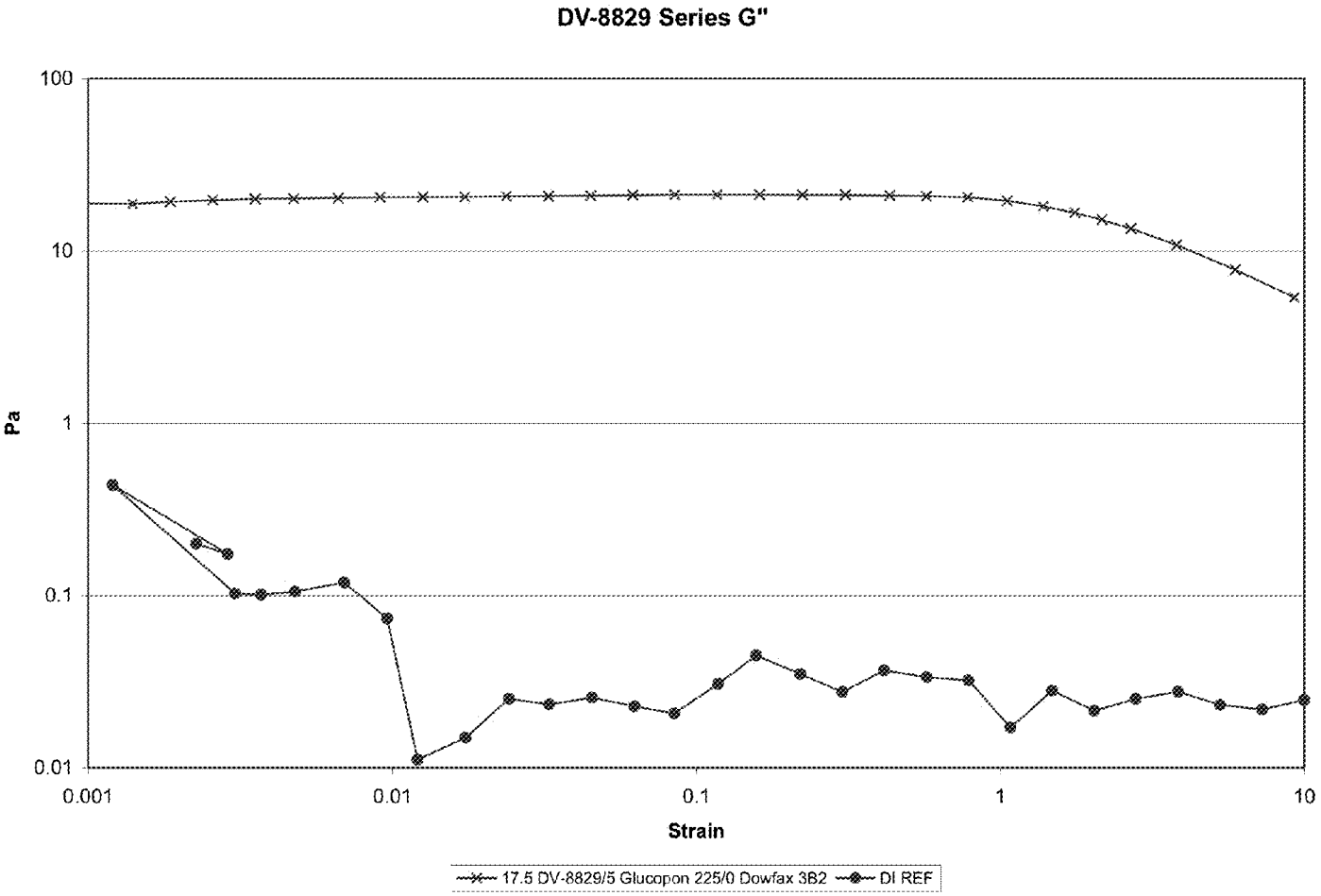

Neutral conditions were also tested in a hand soap formulation utilizing the viscoelastic surfactant DV-8829 in a standard handsoap formulation at 5% by weight of the formulation. The results for G' and G" are shown in FIG. 1. As can be seen it is possible to get viscoelasticity in different types of neutral formulas, however it can be difficult to obtain high levels of viscoelasticity in complex formulations.

Figure 2A:
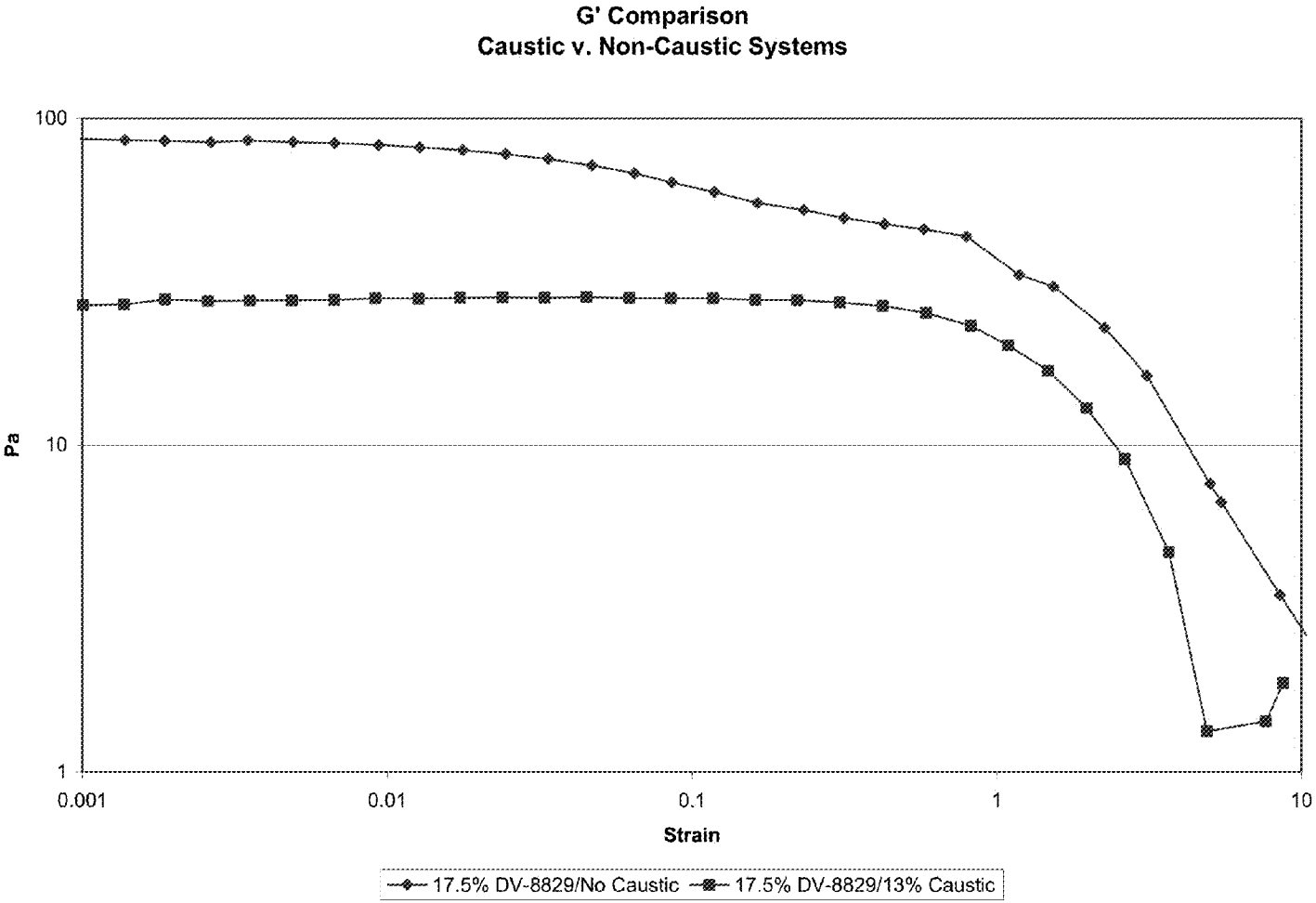
FIGS. 2A and B are graphs depicting G' (elasticity) and G" (viscosity) for a comparison of caustic versus neutral viscoelastic formulas utilizing viscoelastic surfactants. Experiments were performed to determine if viscoelasticity can be achieved in formulas with an alkaline pH. Varying levels of the DV-8829 were used at 17.5% by weight DV-8829 and 13% or no caustic. Applicants surprisingly found that the addition of caustic to the formula has an adverse effect on the viscoelasticity. The addition of caustic decreased the G' (elastic modulus) and increased the G" (viscous modulus) of the formula.
Figure 2B:
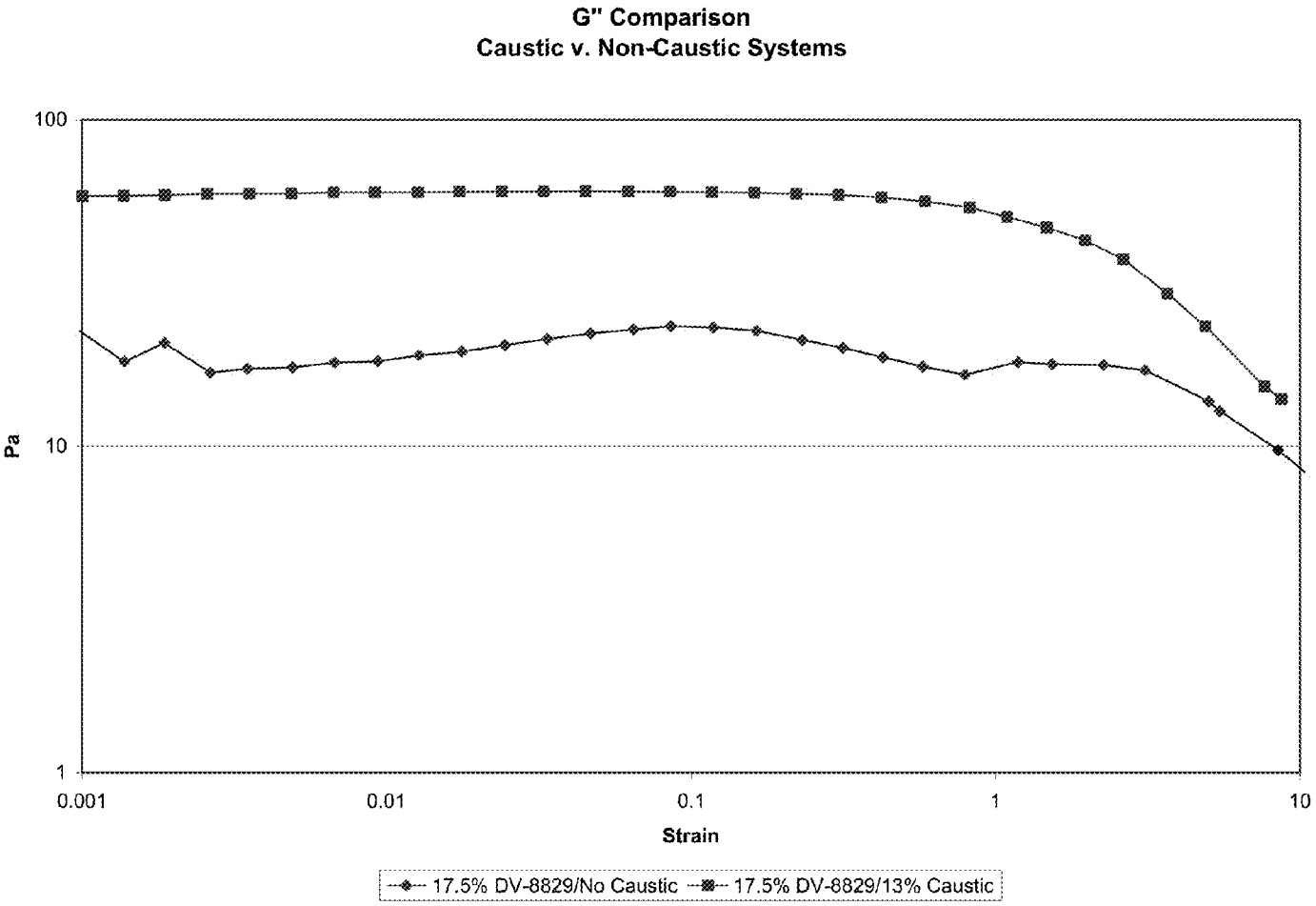

Next a comparison of caustic versus neutral viscoelastic formulas utilizing viscoelastic surfactants was conducted. Experiments were performed to determine if viscoelasticity can be achieved in formulas with an alkaline pH. Varying levels of the DV-8829 were used at 17.5% by weight DV-8829 and 13% or no caustic. Applicants surprisingly found that the addition of caustic to the formula has an adverse effect on the viscoelasticity. The addition of caustic decreased the G' (elastic modulus) and increased the G" (viscous modulus) of the formula. The results are shown in FIG. 2.

Example 2: Creation of Viscoelastic Formulas Utilizing Viscoelastic Surfactants in an Alkaline pH Experiments were performed to determine if viscoelasticity can be achieved in formulas with an alkaline pH. Varying levels of the DV-8829 were used.

TABLE A

| Material Name | % Active | B-9A | D-17 | D-22 | D-27 |
|---|---|---|---|---|---|
| DV-8829 | 45 | 17.5 | 4.40 | 2.23 | 1.12 |
| MEA | | 0.90 | 0.90 | 0.90 | 0.90 |
| NaOH | 50 | 13.00 | 13.00 | 13.00 | 13.00 |
| DI | | 68.60 | 81.70 | 83.87 | 84.98 |
| Total | | 100 | 100 | 100 | 100 |

Figure 3A:
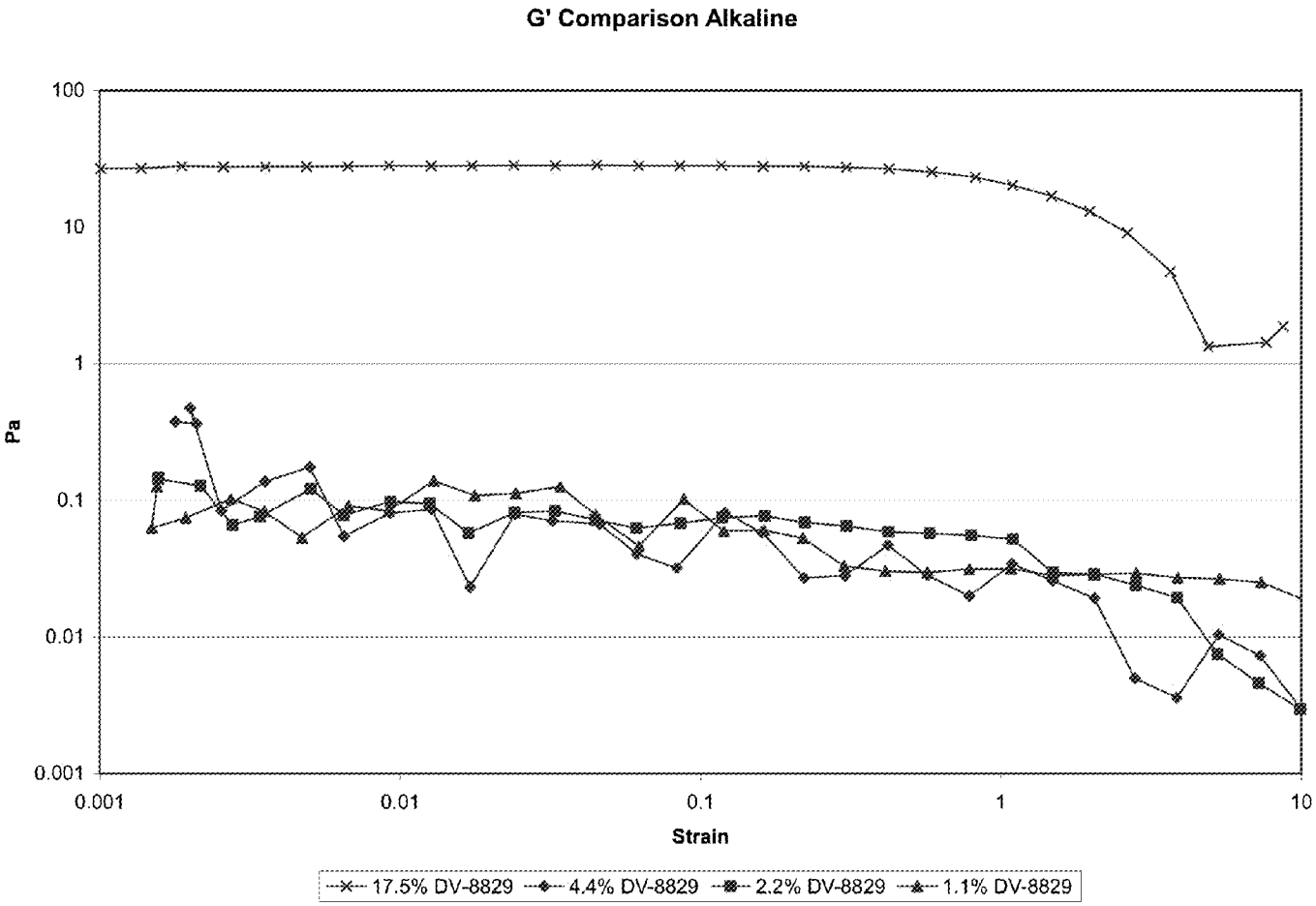
FIGS. 3A and 3B are graphs depicting G' (elasticity) and G" (viscosity) for formulas with an alkaline pH. Varying levels of the DV-8829 were used. High levels of viscoelasticity were achieved at high levels of the viscoelastic surfactant, however, at lower levels of the viscoelastic surfactant, viscoelasticity was not able to be achieved in an alkaline system.
Figure 3B:
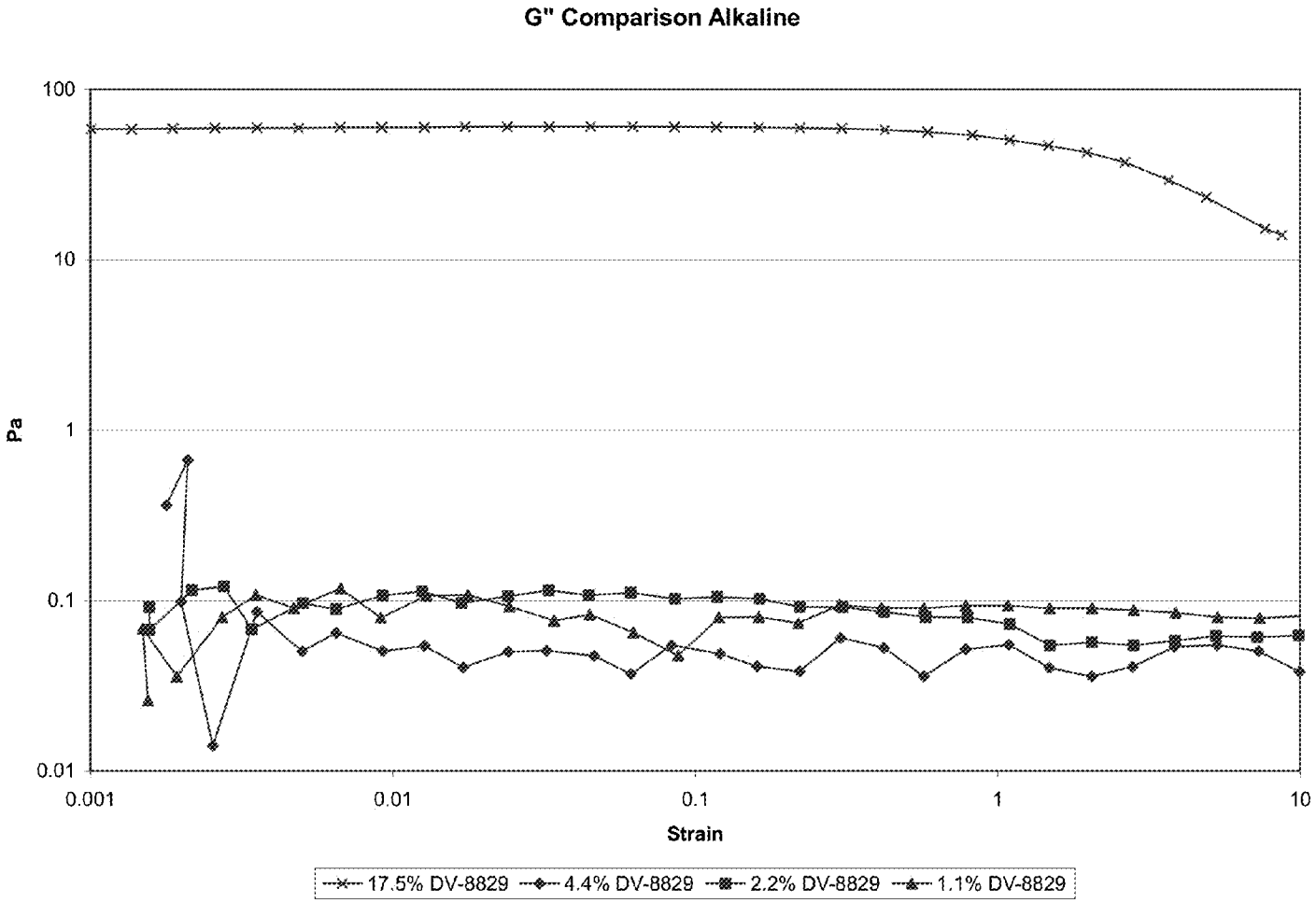

The results are shown in FIGS. 3A (G') and 3B (G"). As can be seen, high levels of viscoelasticity were achieved at high levels of the viscoelastic surfactant, however, at lower levels of the viscoelastic surfactant, viscoelasticity was not able to be achieved in an alkaline system.

A.) The Use of Pseudo Cross Linkers to Increase the Viscoelasticity of Formulas Utilizing Viscoelastic Surfactants.

As can be seen from the previous examples, particularly in alkaline conditions, a fairly large amount of the viscoelastic surfactant is required to achieve high levels of viscoelasticity. Additionally, in alkaline conditions, there is an adverse effect from the addition of caustic that needs to be overcome.

Applicants postulated that Pseudo-cross linking agents would increase the viscoelasticity of the surfactant system. While not wishing to be bound by any theory, it is believed that this pseudo cross linking works through the charge interaction between the pseudo cross linker and the viscoelastic surfactant.

Depending on the pH of the formulation, some of these pseudo cross linkers work better than others. For example, under acidic conditions, the betaine-type viscoelastic surfactants will be more protonated than in neutral or alkaline conditions. Therefore, a pseudo cross linker that will take advantage of the positive quaternary ammonium group will be preferred. In alkaline conditions, the opposite is the case, and pseudo linkers with stronger cationic properties, such as $MgCl_2$, will be preferred.

Examples of suitable pseudo-crosslinking agents included:

Simple salts, such as $MgSO_4$, Mg acetate, Al sulfate, EDTA (Versene 100), DTPA (Hamp-ex 80), STPP, neutralized ATMP (neutralized Dequest 2000), neutralized HEDP (neutralized Dequest 2010), neutralized Bayhibit AM, etc.

Anionic surfactant such as NaLAS, NaLES, Dowfax Hydrotrope, SXS, etc.

Cationic surfactants such as trimethyl alkyl quaternary ammonium.

Figure 4A:
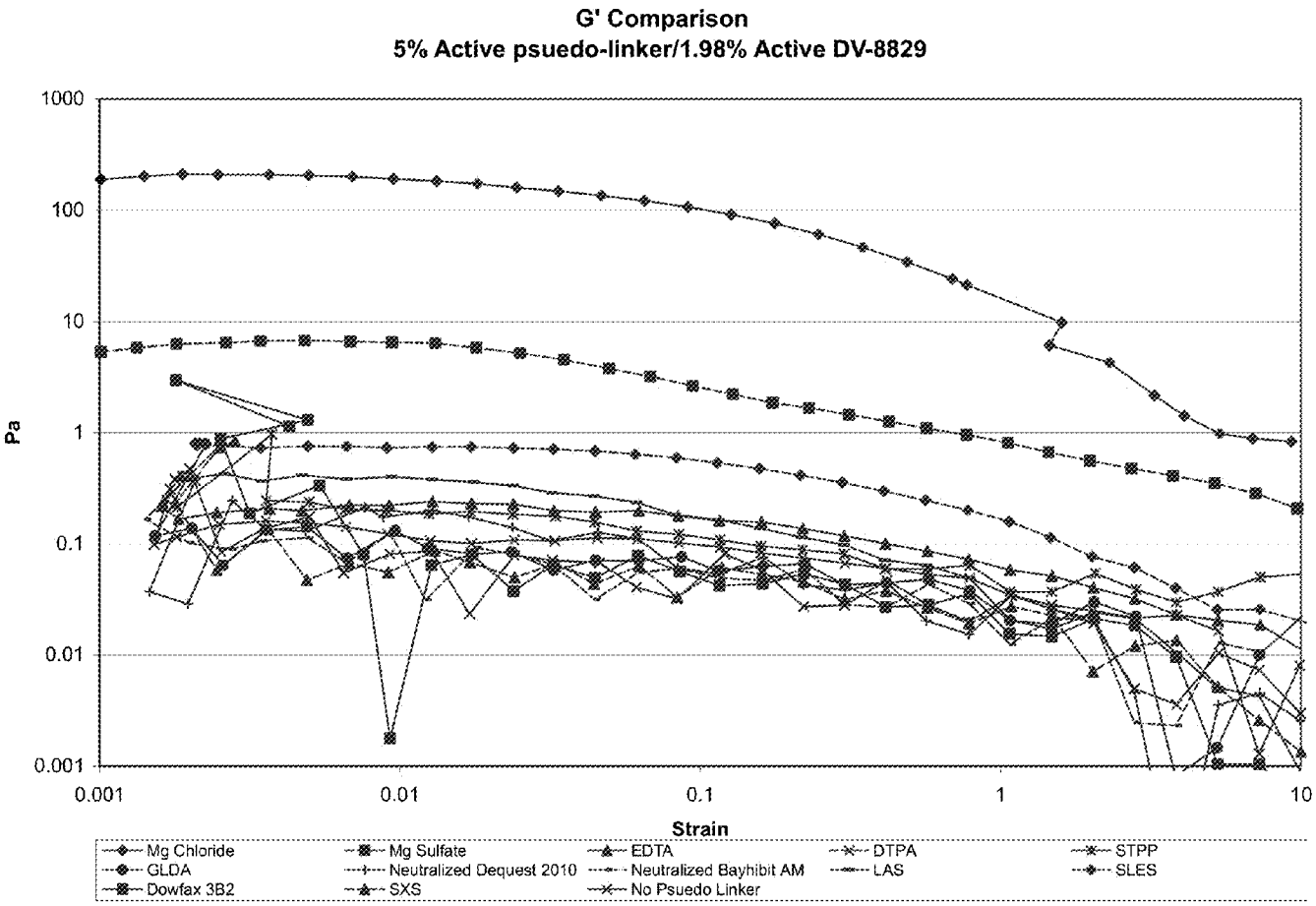
FIGS. 4A and 4B are graphs depicting G' (elasticity) and G" (viscosity) for Tests performed to screen various potential pseudo cross linkers in an alkaline formula.
Figure 4B:
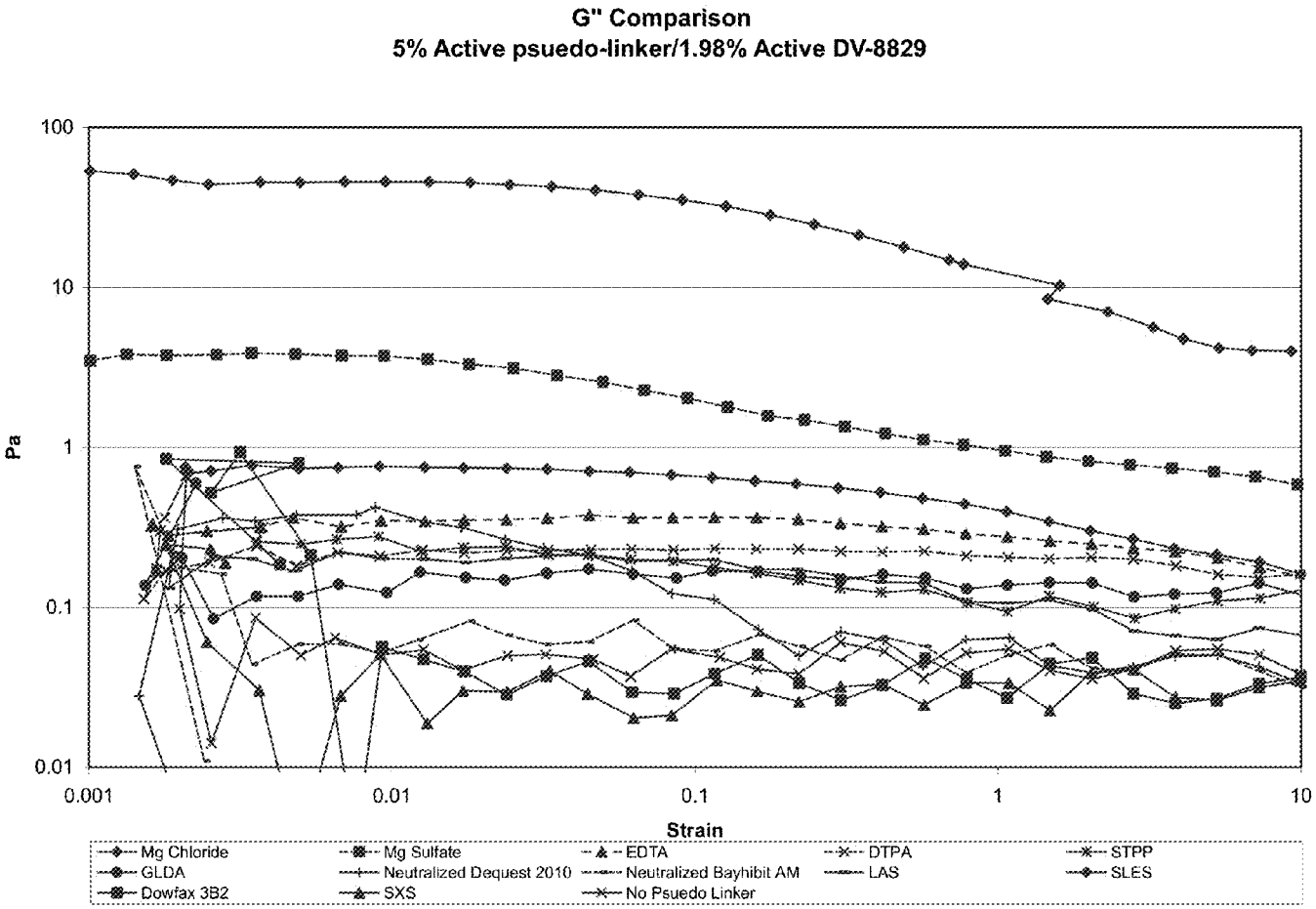

Tests were next performed to screen various potential pseudo cross linkers in an alkaline formula. Formulations were prepared according to Table B. The results are shown in FIGS. 4A (G') and 4B (G").

TABLE B

| Material Name | % Active | D-1 | D-2 | D-5 | D-6 | D-7 | D-8 | D-10 | D-11 | D-12 | D-13 | D-14 | D-15 | D-17 |
|---|---|---|---|---|---|---|---|---|---|---|---|---|---|---|
| DV-8829 | 45 | 4.40 | 4.40 | 4.40 | 4.40 | 4.40 | 4.40 | 4.40 | 4.40 | 4.40 | 4.40 | 4.40 | 4.40 | 4.40 |
| Mg Chloride | 30 | 16.67 | | | | | | | | | | | | |
| Mg Sulfate (heptahydrate) | 50 | | 10.00 | | | | | | | | | | | |
| EDTA (Versene 100) | 40 | | | 12.50 | | | | | | | | | | |
| DTPA | 37.5 | | | | 13.33 | | | | | | | | | |
| STPP | 90 | | | | | 5.56 | | | | | | | | |
| GLDA | 38 | | | | | | 13.16 | | | | | | | |
| Neutralized Dequest 2010 (Dequest + NaOH) | 34.78 | | | | | | | 14.38 | | | | | | |
| Neutralized Bayhibit AM (Bayhibit + NaOH) | 37.41 | | | | | | | | 13.37 | | | | | |
| LAS Flake | 90 | | | | | | | | | 5.56 | | | | |
| SLES | 60 | | | | | | | | | | 8.33 | | | |
| Dowfax 3B2 | 46 | | | | | | | | | | | 10.87 | | |
| SXS | 40 | | | | | | | | | | | | 12.50 | |
| MEA | | 0.90 | 0.90 | 0.90 | 0.90 | 0.90 | 0.90 | 0.90 | 0.90 | 0.90 | 0.90 | 0.90 | 0.90 | 0.90 |
| NaOH | | 13.00 | 13.00 | 13.00 | 13.00 | 13.00 | 13.00 | 13.00 | 13.00 | 13.00 | 13.00 | 13.00 | 13.00 | 13.00 |
| DI | | 65.03 | 71.70 | 69.20 | 68.37 | 76.14 | 68.54 | 67.32 | 68.33 | 76.14 | 73.37 | 70.83 | 69.20 | 81.70 |
| Total | | 100.00 | 100.00 | 100.00 | 100.00 | 100.00 | 100.00 | 100.00 | 100.00 | 100.00 | 100.00 | 100.00 | 100.00 | 100.00 |
| Active Surfactant | | 1.98 | 1.98 | 1.98 | 1.98 | 1.98 | 1.98 | 1.98 | 1.98 | 1.98 | 1.98 | 1.98 | 1.98 | 1.98 |
| Active Linker | | 5 | 5 | 5 | 5 | 5 | 5 | 5 | 5 | 5 | 5 | 5 | 5 | 0 |
| Total Active Linker/ Surfactant | | 6.98 | 6.98 | 6.98 | 6.98 | 6.98 | 6.98 | 6.98 | 6.98 | 6.98 | 6.98 | 6.98 | 6.98 | 1.98 |

Table C shows the various types of pseudo linkers and their effects on viscoelasticity.

| | Pseudo-Linker | Type | Cation | Anion |
|---|---|---|---|---|
| G' | | | | |
| Increase | $MgCl_2$ | Simple Salt | 2+ | 1− (2) |
| | $MgSO_4$ | Simple Salt | 2+ | 2− |
| | NaCl | Simple Salt | 1+ | 1− |
| | SLES (Sodium Lauryl Ether Sulfate) | Anionic Surfactant | 1+ | 1− Sulfate (1), $C_{12}$ Alcohol, $EO_n$ |
| | LAS (Sodium dodecyl benzene sulfonate) | Anionic Surfactant | 1+ | 1− Sulfate(1), cyclic(1), $C_{12}$ Alcohol |
| | EDTA (Ethylenediaminetetraacetic acid) | Simple Salt/Chelant | 1+ (4) | 4− Carboxyl(4), Amine(2) |
| | STPP (sodium tripolyphosphate) | Simple Salt/Chelant | 1+ (5) | 5− Phosphonate (2), PO- (1) |
| | Neutralized Dequest 2010 (1-Hydroxy Ethylidene-1,1-Diphosphonic Acid) | Simple Salt/Chelant | 1+ (5) | 5− Phosphonate (2), CO- (1) |
| | DTPA (Diethylene triamine pentaacetic acid) | Simple Salt/Chelant | 1+ (5) | 5− Carboxyl (5), amine (3) |

-continued

| | Pseudo-Linker | Type | Cation | Anion |
|---|---|---|---|---|
| Approx. = (i.e. no G') | GLDA (glutamic acid diacetic acid, tetra sodium salt) | Simple Salt/Chelant | 1+ (4) | 4– Carboxyl (4), amine (1) |
| | Neutralized Bayhibit AM (Phosphonobutanetricarboxylic acid) | Simple Salt/Chelant | 1+ (5) | 5- Carboxyl (3), phosphonate (1) |
| | Dowfax 3B2 (Alkyldiphenyloxide Disulfonate) | Anionic Surfactant/ Hydrotrope | 1+ (2) | 2– Sulfate(2), cyclic (2), $C_{10}$ Alcohol |
| | SXS (Sodium xylene sulfonate) | Anionic Surfactant/ Hydrotrope | 1+ | 1– Sulfate (1), cyclic (1) |
| G'' | | | | |
| Increase | $MgCl_2$ | Simple Salt | 2+ | 1– (2) |
| | $MgSO_4$ | Simple Salt | 2+ | 2– |
| | NaCl | Simple Salt | 1+ | 1– |
| | SLES (Sodium Lauryl Ether Sulfate) | Anionic Surfactant | 1+ | 1– Sulfate (1), $C_{12}$ Alcohol, $EO_n$ |
| | Neutralized Dequest 2010 (1-Hydroxy Ethylidene-1,1-Diphosphonic Acid) | Simple Salt/Chelant | 1+ (5) | 5– Phosphonate (2), CO- (1) |
| | EDTA (Ethylenediaminetetraacetic acid) | Simple Salt/Chelant | 1+ (4) | 4– Carboxyl(4), Amine(2) |
| | STPP (sodium tripolyphosphate) | Simple Salt/Chelant | 1+ (5) | 5– Phosphonate (2), PO- (1) |
| | DTPA (Diethylene triamine pentaacetic acid) | Simple Salt/Chelant | 1+ (5) | 5– Carboxyl (5), amine (3) |
| | LAS (Sodium dodecyl benzene sulfonate) | Anionic Surfactant | 1+ | 1– Sulfate(1), cyclic(1), $C_{12}$ Alcohol |
| | GLDA (glutamic acid diacetic acid, tetra sodium salt) | Simple Salt/Chelant | 1+ (4) | 4– Carboxyl (4), amine (1) |
| Approx. = | Neutralized Bayhibit AM (Phosphonobutanetricarboxylic acid) | Simple Salt/Chelant | 1+ (5) | 5– Carboxyl (3), phosphonate (1) |
| Decrease | Dowfax 3B2 (Alkyldiphenyloxide Disulfonate) | Anionic Surfactant/ Hydrotrope | 1+ (2) | 2– Sulfate(2), cyclic (2), $C_{10}$ Alcohol |
| | SXS (Sodium xylene sulfonate) | Anionic Surfactant/ Hydrotrope | 1+ | 1– Sulfate (1), cyclic (1) |

The results show that the multiply charged cation, Mg2+ appeared to be the most effective pseudo cross linker. It should be noted, however, that an $MgOH_2$ precipitate formed under highly caustic conditions. Therefore, other forms of alkalinity, hydrotroping, or a different linker such as a soft multiply charged cation, such as calcium or aluminum, may be preferred. Also, a doubly charged anion is less effective than a singly charged anion with the Mg2+ pseudo cross linker.

Anionic surfactants SLES and LAS showed effectiveness as pseudo cross linkers. EDTA, STPP, Neutralized Dequest 2010 and DTPA all had some effectiveness as pseudo cross linking agents. A cyclic structure in a viscoelastic surfactant system will decrease the G' and significantly decrease the G".

Next varying levels of DV-8829 with EDTA as a pseudo cross linkers in an alkaline pH system was tested. A test was run with varying levels of the viscoelastic surfactant in an alkaline system utilizing a pseudo cross linker.

TABLE D

| Material Name | % Active | EXP B-9 | EXP B-10 | EXP B-11 | EXP B-12 |
|---|---|---|---|---|---|
| DV-8829 | 45 | 17.5 | 8.75 | 4.4 | 2.2 |
| EDTA (Versene 100) | 40 | 5 | 5 | 5 | 5 |

TABLE D-continued

| Material Name | % Active | EXP B-9 | EXP B-10 | EXP B-11 | EXP B-12 |
|---|---|---|---|---|---|
| MEA | | 0.9 | 0.9 | 0.9 | 0.9 |
| NaOH | | 13 | 13 | 13 | 13 |
| DI | | 77.5 | 86.25 | 90.6 | 92.8 |
| Total | | 100 | 100 | 100 | 100 |
| Active Surfactant | | 7.875 | 3.9375 | 1.98 | 0.99 |
| Active Linker | | 2 | 2 | 2 | 2 |
| Total Active Linker/Surfactant | | 9.875 | 5.9375 | 3.98 | 2.99 |

Figure 5A:
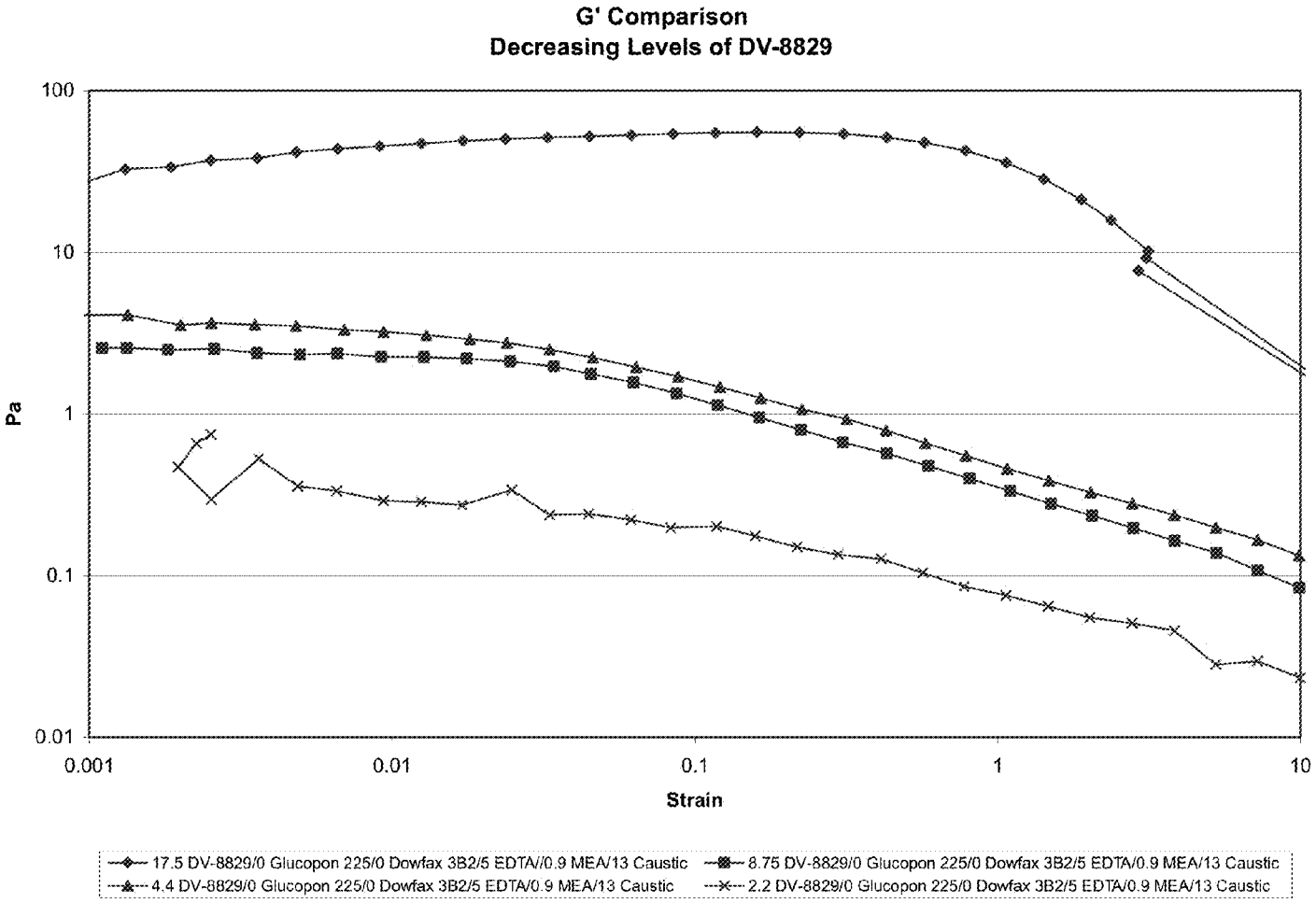
FIGS. 5A and 5B are graphs depicting G' (elasticity) and G" (viscosity) for varying levels of DV-8829 with EDTA as a pseudo cross linkers in an alkaline pH. The results show that good viscoelasticity was seen in caustic systems with the DV-8829 surfactant with lower levels of the DV-8829 surfactant when utilizing a pseudo cross linker.
Figure 5B:
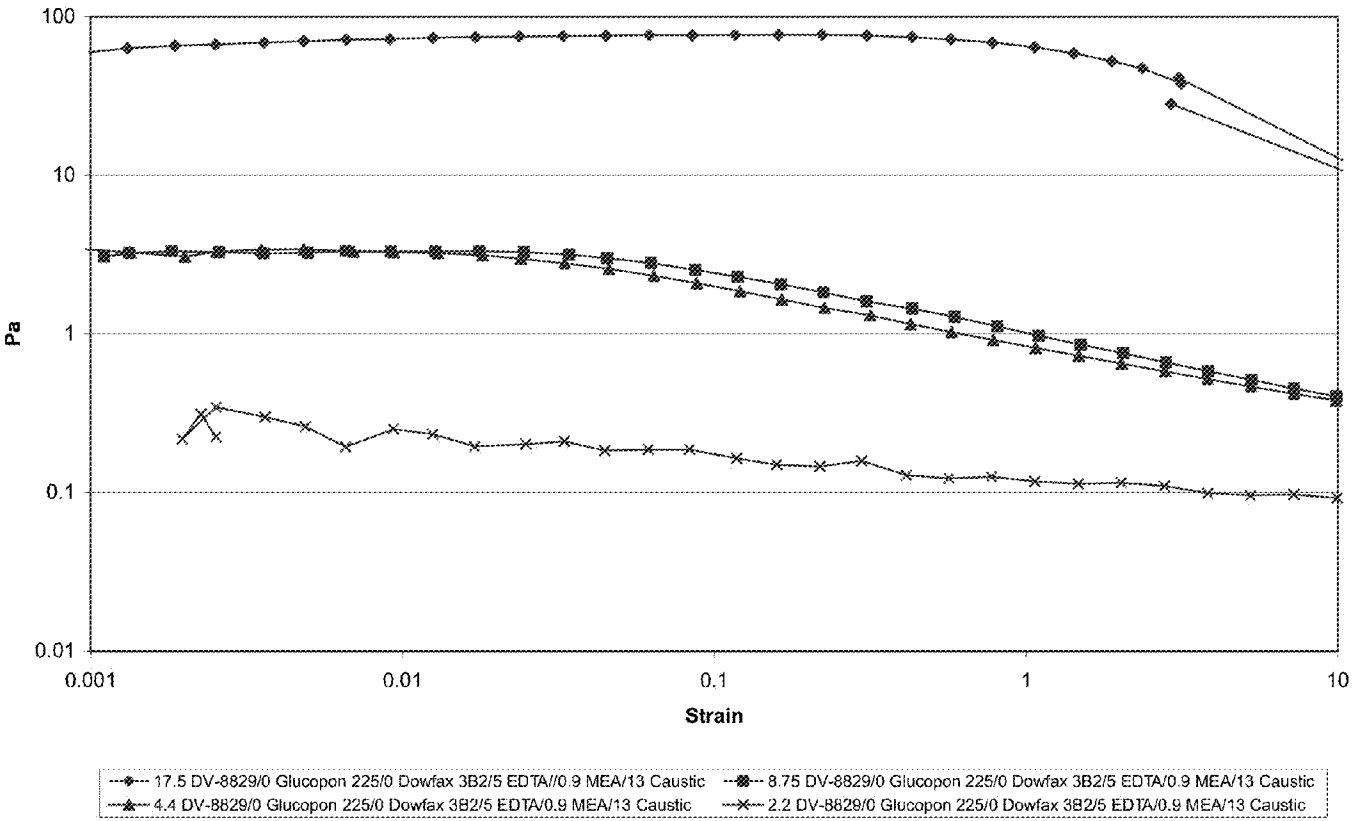

The results are shown in FIGS. 5A (G') and 5B (G"). Good viscoelasticity was seen in caustic systems with the DV-8829 surfactant with lower levels of the DV-8829 surfactant when utilizing a pseudo cross linker.

Figure 6A:
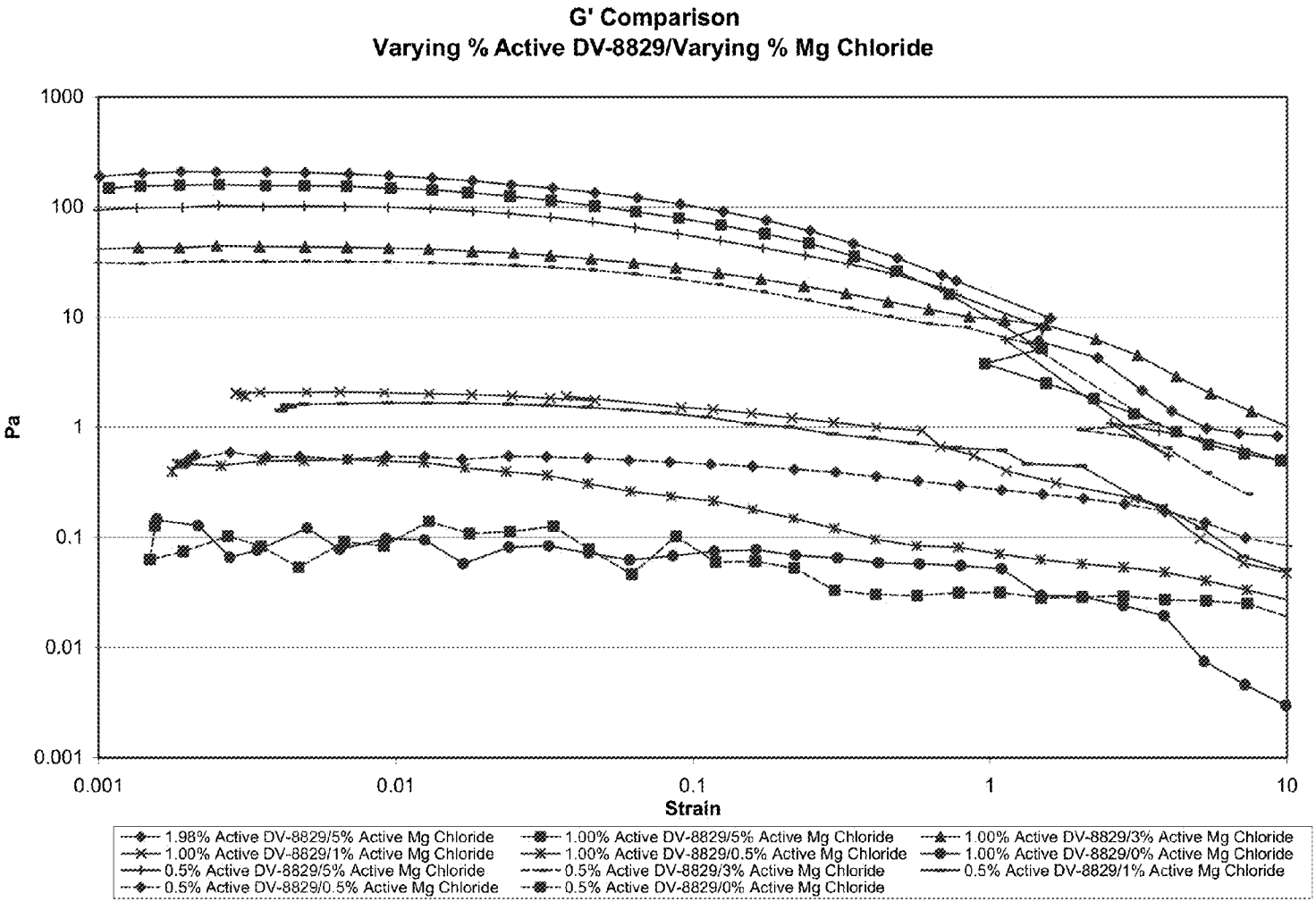
FIGS. 6A and 6B are graphs depicting G' (elasticity) and G" (viscosity) for a test to analyze different levels of the viscoelastic surfactant DV-8829.
Figure 6B:
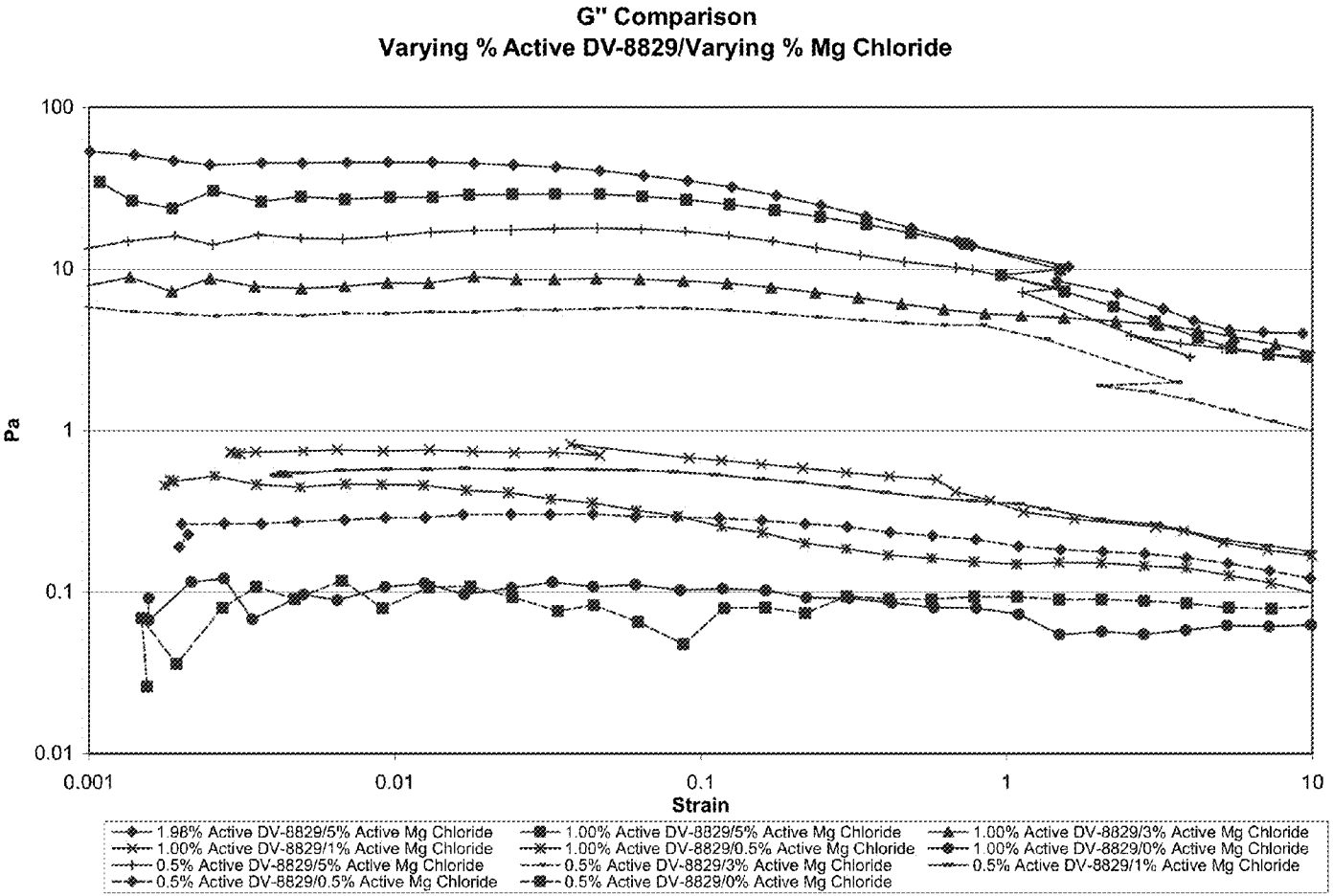

In the next example, a test to analyze the dependence on the system to the concentration of the viscoelastic surfactant to the concentration of the linker was performed. See Table D. Results are show in FIGS. 6A (G') and 6B (G").

TABLE E

| Material Name | % Active | D-1 | D-18 | D-19 | D-20 | D-21 | D-22 | D-23 | D-24 | D-25 | D-26 | D-27 |
|---|---|---|---|---|---|---|---|---|---|---|---|---|
| DV-8829 | 45 | 4.40 | 2.23 | 2.23 | 2.23 | 2.23 | 2.23 | 1.12 | 1.12 | 1.12 | 1.12 | 1.12 |
| Mg Chloride | 30 | 16.67 | 16.67 | 10.00 | 3.33 | 1.67 | 0.00 | 16.67 | 10.00 | 3.33 | 1.67 | 0.00 |

TABLE E-continued

| Material Name | % Active | D-1 | D-18 | D-19 | D-20 | D-21 | D-22 | D-23 | D-24 | D-25 | D-26 | D-27 |
|---|---|---|---|---|---|---|---|---|---|---|---|---|
| MEA | | 0.90 | 0.90 | 0.90 | 0.90 | 0.90 | 0.90 | 0.90 | 0.90 | 0.90 | 0.90 | 0.90 |
| NaOH | | 13.00 | 13.00 | 13.00 | 13.00 | 13.00 | 13.00 | 13.00 | 13.00 | 13.00 | 13.00 | 13.00 |
| DI | | 65.03 | 53.30 | 59.97 | 66.64 | 68.30 | 69.97 | 54.41 | 61.08 | 67.75 | 69.41 | 71.08 |
| Total | | 100.00 | 100.00 | 100.00 | 100.00 | 100.00 | 100.00 | 100.00 | 100.00 | 100.00 | 100.00 | 100.00 |
| Active Surfactant | | 1.98 | 1.00 | 1.00 | 1.00 | 1.00 | 1.00 | 0.50 | 0.50 | 0.50 | 0.50 | 0.50 |
| Active Linker | | 5 | 5 | 3 | 1 | 0.5 | 0 | 5 | 3 | 1 | 0.5 | 0 |

Figure 7A:
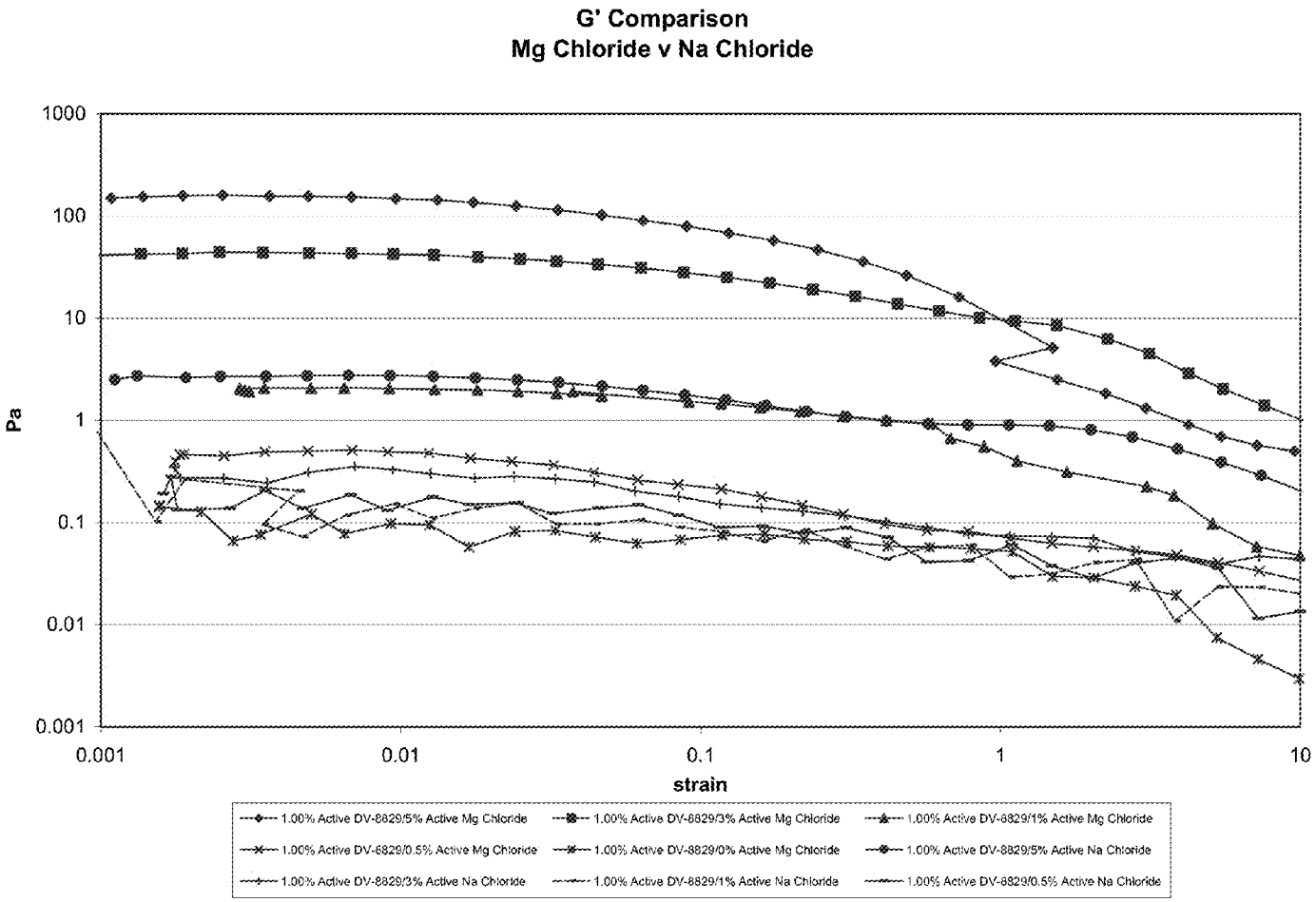
FIGS. 7A and 7B are graphs depicting G' (elasticity) and G" (viscosity) for varying levels of $Mg^{2+}$. The results show that there is good viscoelasticity in caustic systems with the DV-8829 surfactant with very low levels of the DV-8829 surfactant when utilizing a multiply charged cation, $Mg^{2+}$, as a pseudo cross linker. The results also show that the pseudo linker concentration plays a vital role in the viscoelasticity of the system.
Figure 7B:
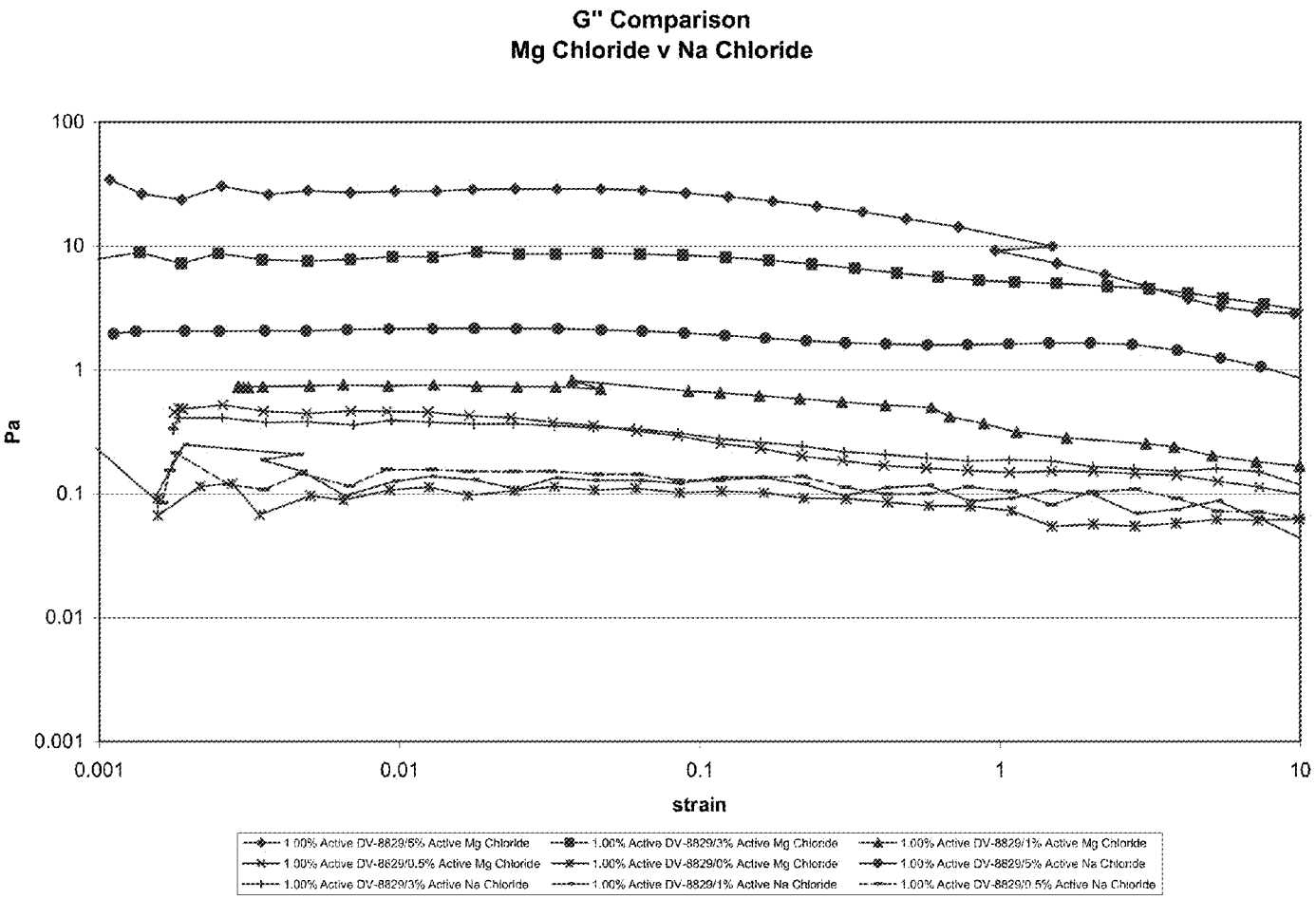

The results in FIGS. 7A (G') and 7B (G") show that there is good viscoelasticity in caustic systems with the DV-8829 surfactant with very low levels of the DV-8829 surfactant when utilizing a multiply charged cation, $Mg^{2+}$, as a pseudo cross linker. The results also show that the pseudo linker concentration plays a vital role in the viscoelasticity of the system. The level of pseudo cross linker seems to have a larger effect on the viscoelasticity than the surfactant concentration. This leads to the conclusion that charge interaction between the viscoelastic surfactant and the pseudo cross linker is playing a major role in the viscoelasticity of the system.

Figure 8A:
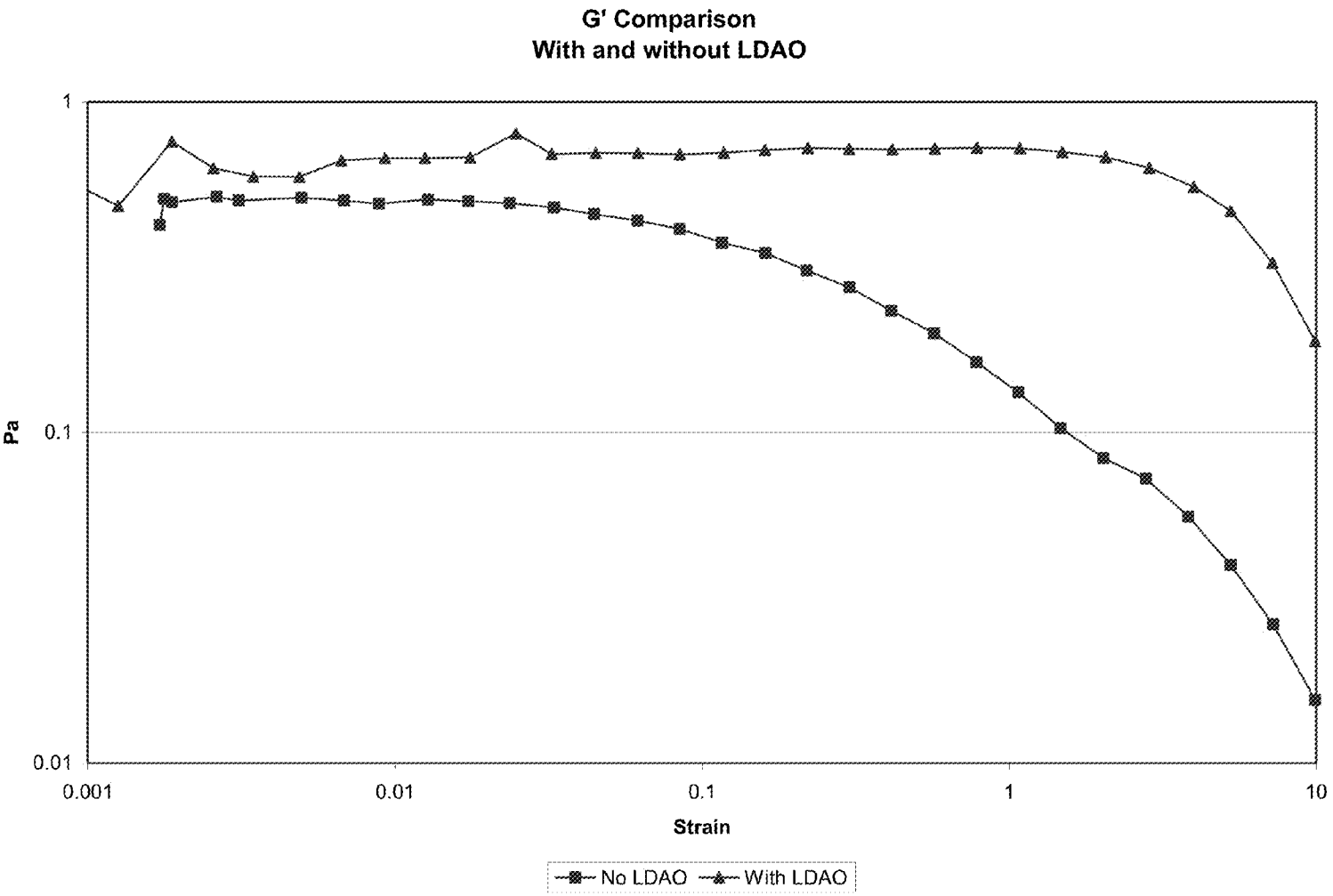
FIGS. 8A and 8B are graphs depicting G' (elasticity) and G" (viscosity) for an Evaluation of Lauryl Dimethylamine Oxide as a pseudo cross linker and alternative viscoelastic surfactant.
Figure 8B:
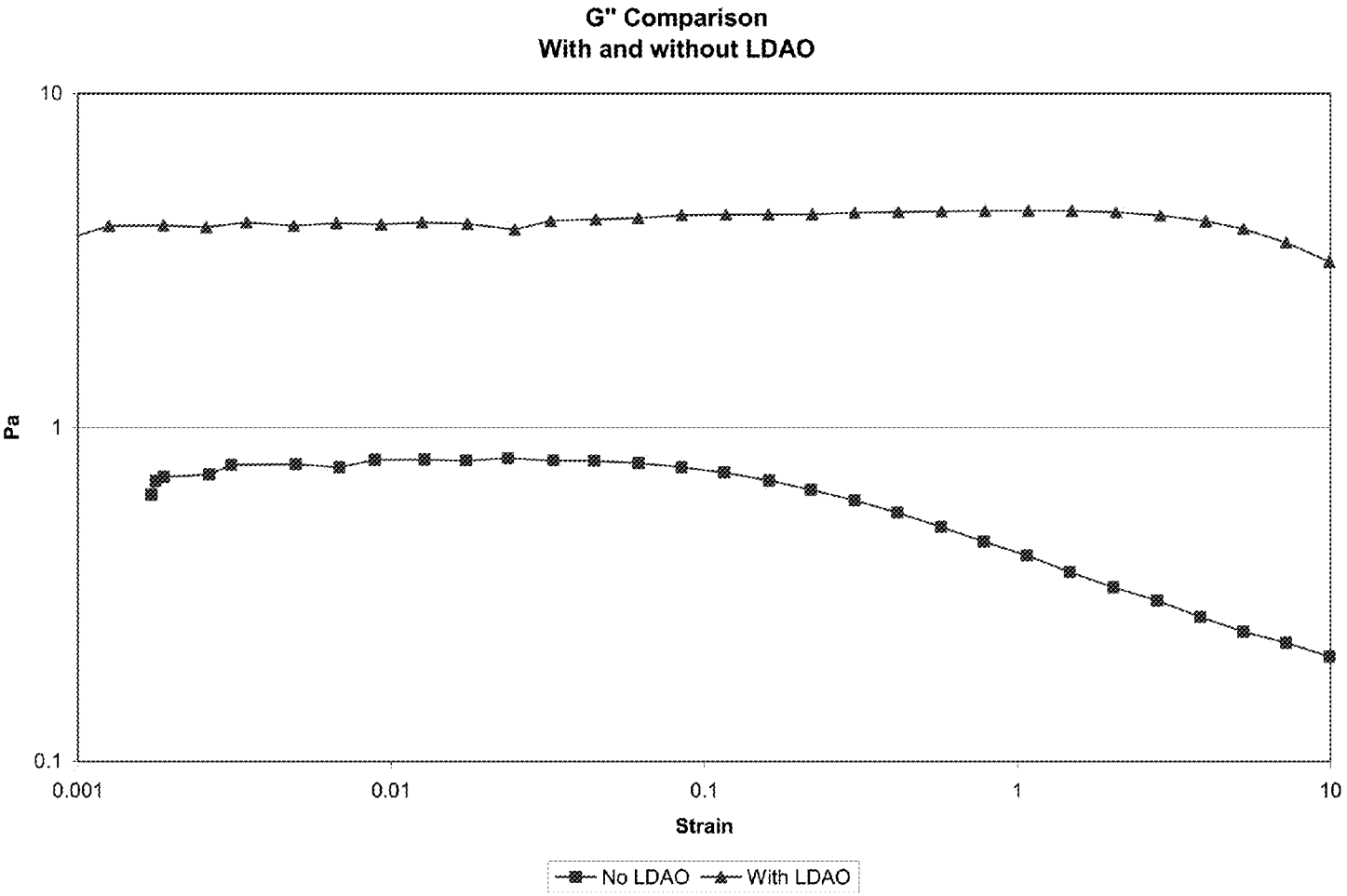

Next an Evaluation of Lauryl Dimethylamine Oxide as a pseudo cross linker and alternative viscoelastic surfactant was conducted. LDAO (Barlox 12) was used as a Pseudo cross linker to determine if it will act as a pseudo cross linker. Results are showing in FIGS. 8A (G') and 8B (G").

TABLE F

| Material Name | % Active | DVE-4 | DVE-5 |
|---|---|---|---|
| DV-8829 | 45 | 5.00 | 5.00 |
| Barlox 12 | 30 | 5.00 | 0 |
| NaOH | 50 | 20.00 | 20.00 |
| DI | | 70.00 | 75.00 |
| Total | | 100 | 100 |

The results show that Lauryl Dimethylamine Oxide can be used as a pseudo cross linking agent. This pseudo cross linking is likely due to the fact that the viscoelastic surfactant can take advantage of both the positive and negative charges on the LDAO. Likely, numerous other amphoteric and zwitterionic surfactants will also prove to be efficient pseudo cross linking agents. Due to the fact that LDAO has both a positive and negative charge, it is likely that it can be used as a viscoelastic surfactant itself.

Next a series of other viscoelastic surfactants were tested with MgCl as the pseudo cross linker. As the pseudo cross linker can increase the viscoelasticity of a viscoelastic surfactant system, a test was performed to determine if surfactants other than the long-chain betaine (DV-8829) can create viscoelastic systems. Surfactants tested were dicarboxylic coconut derive, Sodium salt (Miranol C2M-SF), cocamidopropyl dimethylamine (Mackine GO-163), cocoamidopropyl betaine, and alkylether hydroxypropyl sultaine (Mirataine ASC). These were all tested with $Mg^{2+}$, as a pseudo cross linker. These systems were compared against two commercially available formulas.

TABLE G

| Material Name | % Active | D-1 | D-28 | D-29 | D-30 | D-54 |
|---|---|---|---|---|---|---|
| Mirataine ASC | 42 | | | | | 4.71 |
| Cocoamido-propyl Betaine | 35 | | | | 5.66 | |
| Miranol | 38 | | 5.21 | | | |
| Mackine GO-163 | 100 | | | 1.98 | | |
| DV-8829 | 45 | 4.40 | | | | |
| Mg Chloride | 30 | 16.67 | 16.67 | 16.67 | 16.67 | 16.67 |
| MEA | | 0.90 | 0.90 | 0.90 | 0.90 | 0.90 |
| NaOH | | 13.00 | 13.00 | 13.00 | 13.00 | 13.00 |
| DI | | 65.03 | 64.22 | 67.45 | 63.77 | 64.72 |
| Total | | 100.00 | 100.00 | 100.00 | 100.00 | 100.00 |
| Active Surfactant | | 1.98 | 1.98 | 1.98 | 1.98 | 1.98 |
| Active Linker | | 5 | 5 | 5 | 5 | 5 |

Figure 9A:
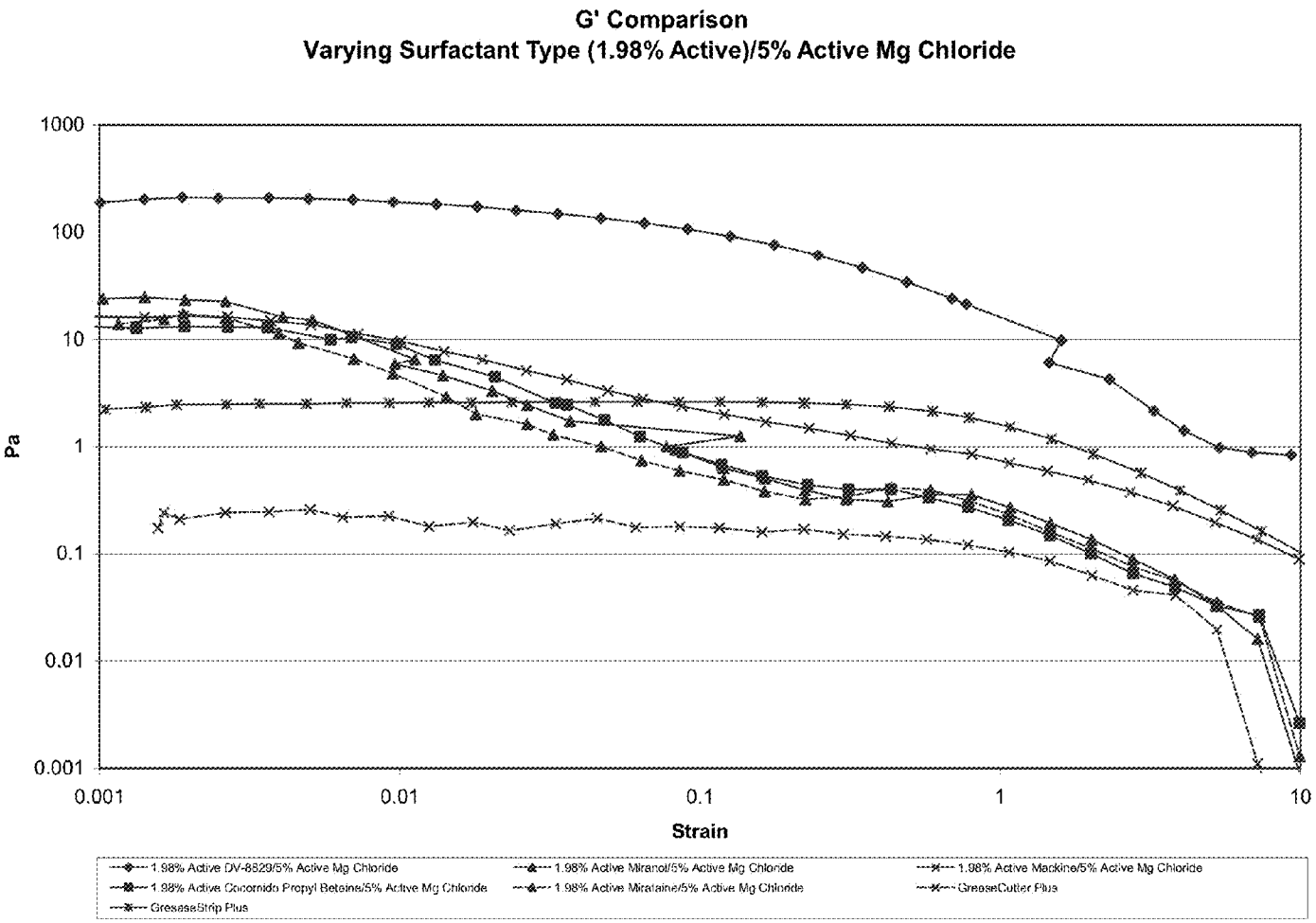
FIGS. 9A and 9B are graphs depicting G' (elasticity) and G" (viscosity) for a series of other viscoelastic surfactants tested with MgCl as the pseudo cross linker. Surfactants tested were dicarboxylic coconut derive, Sodium salt (Miranol C2M-SF), cocamidopropyl dimethylamine (Mackine GO-163), cocoamidopropyl betaine, and alkylether hydroxypropyl sultaine (Mirataine ASC). These were all tested with $Mg^{2+}$, as a pseudo cross linker. These systems were compared against two commercially available formulas. The graphs show that viscoelasticity can be achieved with surfactants other than the DV-8829, such as dicarboxylic coconut derive sodium salt (Miranol C2M-SF), cocamidopropyl dimethylamine (Mackine GO-163), cocoamidopropyl betaine, and alkylether hydroxypropyl sultaine (Mirataine ASC) using a pseudo cross linker.
Figure 9B:
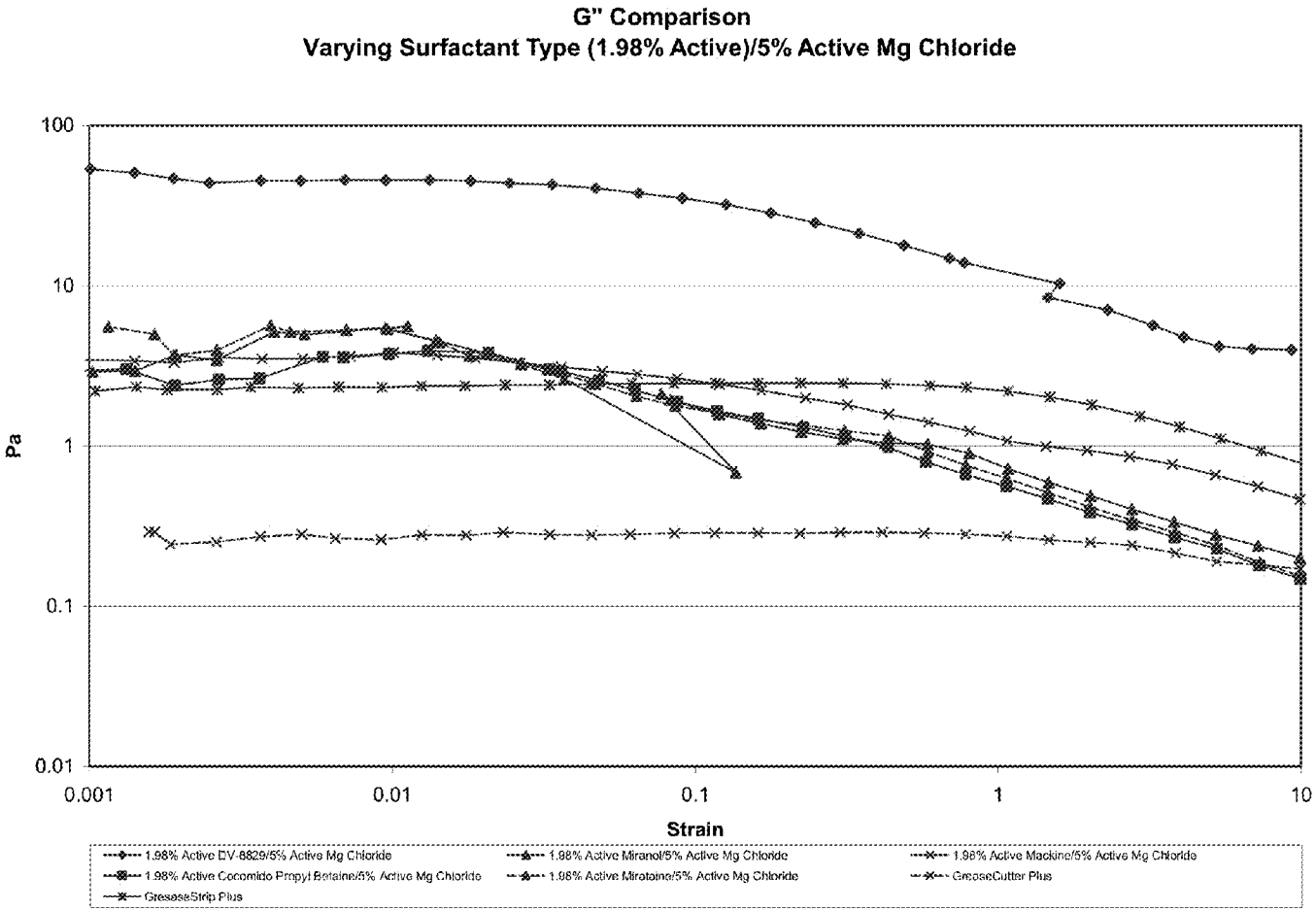

The results are depicted in FIGS. 9A and 9B and show that viscoelasticity can be achieved with surfactants other than the DV-8829, such as dicarboxylic coconut derive sodium salt (Miranol C2M-SF), cocamidopropyl dimethylamine (Mackine GO-163), cocoamidopropyl betaine, and alkylether hydroxypropyl sultaine (Mirataine ASC) using a pseudo cross linker. It is also believed that sultaine-type surfactants will also create viscoelastic formulations.

What is claimed is:

1. A neutral or alkaline viscoelastic cleaning composition comprising:

(a) a source of alkalinity, (b) a non polymer viscoelastic surfactant having the following formula:

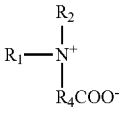

wherein $R_1$ represents a hydrophobic moiety of alkyl, alkylarylalkyl, alkoxyalkyl, alkylaminoalkyl and alkylamidoalkyl, wherein alkyl represents a group that contains from about 16 to about 22 carbon atoms which may be branched or straight chained and which may be saturated or unsaturated;

$R_2$ is an aliphatic chain having from 1 to about 30 atoms in which the aliphatic group can be branched or straight chained, saturated or unsaturated; and R4 is a hydrocarbyl radical (e.g. alkylene) with chain length 1 to 4;

(c) a pseudo linker selected from the group consisting of:

i) a salt with a multiply charged cation selected from the group consisting of MgSO4, Mg acetate, and Al sulfate;

ii) an alkali metal salt selected from the group consisting of an alkali meta carbonate, silicate, phosphonate, sulfate, borate, neutralized ethylenediaminetetraacetic add, neutralized diethylene triamine pentaacetic add, sodium tripolyphosphate, neutralized aminotris(methylenephsophonic add), neutralized 1-hydroxyethane 1,1-disphosphonic add, neutralized 2-phosphonobutane-1,2,4-tricarboxylic add, and/or combinations thereof;

iii) an anionic surfactant selected from the group consisting of: a linear C10-C14 alkyl benzene sultanate (LAS), a branched C10-C14 alkyl benzene sulfonate (ABS), a tallow alkyl sulfate, a coconut alkyl glyceryl ether sulfonate, a sulfated condensation product of mixed C10-C18 tallow alcohols with from about 1 to about 14 moles of ethylene oxide, a mixture of higher fatty acids containing from 10 to 18 carbon atoms, neutralized diphenyloxide disulfonic add, sodium xylene sulfonate, NaLAS, NaLES; or iv) a cationic surfactant, wherein said pseudo linker is present in a ratio greater than 1:1 of active percent by weight of linker to active percent by weight of non-polymer viscoelastic surfactant.

2. The pseudo linker of claim 1 wherein said pseudo linker is a salt with a multiply charged cation.

3. The pseudo linker of claim 1 wherein said salt is an alkali metal salt.

4. The pseudo linker for claim 1 wherein said alkali metal salt is an alkali metal carbonate, silicate, phosphonate, sulfate, borate and/or mixtures thereof.

5. The pseudo linker of claim 1 wherein said alkali metal salt or salt with a multiply charged cation is MgSO4, Mg acetate, Al sulfate, neutralized Ethylenediaminetetraacetic acid, neutralized Diethylene triamine pentaacetic acid, sodium tripolyphosphate, neutralized amino tris(methylenephosphonic acid), neutralized 1-hydroxyethane 1,1-diphosphonic acid, and neutralized 2-phosphonobutane-1,2,4-tricarboxylic acid.

6. The pseudo linker of claim 1 wherein said pseudo linker is NaLAS, NaLES, neutralized diphenyloxide disulfonic acid, and/or sodium xylene sulfonate.

7. The pseudo linker of claim 1 wherein said pseudo linker is a cationic surfactant.

8. The pseudo linker of claim 7 wherein said cationic surfactant is a quaternary ammonium salt.

9. The pseudo linker of claim 8 wherein said quaternary ammonium salt is an alkylquatemary ammonium chloride or a naphthylene-substituted quaternary ammonium chloride.

10. The composition of claim 1 wherein said viscoelastic surfactant is present in an amount of from about 0.1 wt. % to about 2 wt. % of pseudo linker.

11. The composition of claim 1 wherein said pseudo linker is present in an amount from about 0.2 wt. % to about 5% by weight of said composition.

12. A method of cleaning an object comprising:

contacting the object with a viscoelastic cleaning composition according to claim 1 for a predetermined time; and thereafter, rinsing the cleaning composition from the object so that the cleaning composition and any soils or debris are washed away.

13. The method of claim 12 wherein said object is a pipe or vessel in a food processing plant, wares, laundry, an oven, a grill, or a floor, a carpet, a medical device.

14. The method of claim 12 wherein said composition is provided in a concentrate.

15. The method of claim 14 further comprising the step of: diluting said concentrate.

16. The method of claim 12 wherein said step of contacting said object is by spraying said composition.

* * * * *